US011788715B2

(12) United States Patent
Ninomiya et al.

(10) Patent No.: US 11,788,715 B2
(45) Date of Patent: Oct. 17, 2023

(54) LIGHTING DEVICE AND LIGHT INSTALLATION METHOD

(71) Applicant: NICHIA CORPORATION, Anan (JP)

(72) Inventors: Susumu Ninomiya, Niigata (JP); Tetsutoshi Ishida, Niigata (JP); Kei Haraguchi, Tokushima (JP)

(73) Assignee: Nichia Corporation, Anan (JP)

( * ) Notice: Subject to any disclaimer, the term of this patent is extended or adjusted under 35 U.S.C. 154(b) by 16 days.

(21) Appl. No.: 17/621,461

(22) PCT Filed: Jun. 16, 2020

(86) PCT No.: PCT/JP2020/023536
§ 371 (c)(1),
(2) Date: Dec. 21, 2021

(87) PCT Pub. No.: WO2020/262099
PCT Pub. Date: Dec. 30, 2020

(65) Prior Publication Data

US 2022/0178521 A1 Jun. 9, 2022

(30) Foreign Application Priority Data

Jun. 27, 2019 (JP) ..... 2019-120090
Aug. 5, 2019 (JP) ..... 2019-144010

(51) Int. Cl.
*F21V 21/02* (2006.01)
*F21S 8/00* (2006.01)

(52) U.S. Cl.
CPC ..... *F21V 21/02* (2013.01); *F21S 8/03* (2013.01)

(58) Field of Classification Search
CPC ..... F21V 21/02; F21S 8/03
See application file for complete search history.

(56) References Cited

U.S. PATENT DOCUMENTS 4,306,765 A 12/1981 Winzer et al.
2011/0310604 A1 12/2011 Shimizu et al.
2020/0049330 A1* 2/2020 Plaja Miro ..... H02G 3/123

FOREIGN PATENT DOCUMENTS

JP S55-124108 A 9/1980
JP S61-93904 U 6/1986
(Continued)

*Primary Examiner* — Thomas M Sember
(74) *Attorney, Agent, or Firm* — Kim & Stewart LLP

(57) ABSTRACT

Provided are a lighting device in which adjacent lighting appliances appears continuous with inconspicuous joint therebetween, and a method for constructing a building.

Each of a first lighting appliance and a second lighting appliance includes a lighting appliance body including a chassis, and a plurality of light sources, a fitting adapter disposed on the rear surface of the chassis, the fitting adapter being fitted into a mounting hole formed in a building material, and a light-transmissive cover.

The first lighting appliance and the second lighting appliance are arranged adjacent to each other with respective corresponding ones of the lateral surface portions abutting against each other, The first lighting appliance includes a first coupling member disposed on the rear surface of the chassis, and the second lighting appliance includes a second coupling member disposed on the rear surface of the chassis.

The first coupling member and the second coupling member are coupled on the rear surface with the first lighting appliance and the second lighting appliance adjacent to each other with the respective corresponding ones of the lateral surface portions abutting against each other.

17 Claims, 24 Drawing Sheets

(56) References Cited

FOREIGN PATENT DOCUMENTS

| | | | |
|---|---|---|---|
| JP | H05-17809 | A | 1/1993 |
| JP | 2003-297113 | A | 10/2003 |
| JP | 2012-084504 | A | 4/2012 |
| JP | 2012-129065 | A | 7/2012 |
| JP | 2012-248308 | A | 12/2012 |
| JP | 2013-120673 | A | 6/2013 |
| JP | 2013-201090 | A | 10/2013 |
| JP | 2015-032404 | A | 2/2015 |
| JP | 2016-035841 | A | 3/2016 |
| JP | 2017-016823 | A | 1/2017 |
| JP | 2017-054616 | A | 3/2017 |
| JP | 2017-054617 | A | 3/2017 |
| JP | 2017-224489 | A | 12/2017 |
| JP | 2018-088309 | A | 6/2018 |
| JP | 2018-185910 | A | 11/2018 |
| JP | 2019-164917 | A | 9/2019 |

* cited by examiner

LIGHTING DEVICE AND LIGHT INSTALLATION METHOD

TECHNICAL FIELD

The present disclosure relates to a lighting device and a method for constructing a building.

BACKGROUND ART

In installation of a plurality of lighting appliances adjacent to each other, if there is distortion or the like in the building materials (for example, ceiling materials or wall materials) to which the lighting appliances are to be attached, a stepped portion (misalignment) may be formed between the adjacent lighting appliances.

For example, Patent Literature 1 discloses a configuration in which, to couple two lighting units, a protruding portion on an end cover of one of the lighting units is inserted into an insertion hole defined in an end cover of the other of the lighting units.

CITATION LIST

Patent Literature

Patent Literature 1: JP 2018-185910 A

SUMMARY OF INVENTION

Problem to Be Solved

An object of the present disclosure is to provide a lighting device in which adjacent lighting appliances appears continuous with inconspicuous joint therebetween, and a method for constructing a building.

Solution to Problem

According to one aspect of the present disclosure, a lighting device includes a first lighting appliance, and a second lighting appliance. Each of the first lighting appliance and the second lighting appliance includes a lighting appliance body including a chassis having a light source placement surface and a rear surface opposite to the light source placement surface, and a plurality of light sources disposed on the light source placement surface, a fitting adapter disposed on the rear surface of the chassis, the fitting adapter being fitted into a mounting hole formed in a building material, and a light-transmissive cover including a main surface portion facing the light source placement surface across a space, and lateral surface portions covering a lateral side of the space. The first lighting appliance and the second lighting appliance are arranged adjacent to each other with respective corresponding ones of the lateral surface portions abutting against each other. The first lighting appliance includes a first coupling member disposed on the rear surface of the chassis, and the second lighting appliance includes a second coupling member disposed on the rear surface of the chassis. The first coupling member and the second coupling member are coupled on the rear surface with the first lighting appliance and the second lighting appliance adjacent to each other with the respective corresponding ones of the lateral surface portions abutting against each other.

According to one aspect of the present disclosure, a method for constructing a building includes: providing, among a plurality of wirings disposed on a rear of a ceiling formed with a plurality of ceiling materials, connector-attached wirings as wirings used for electrical connection to lightweight large lighting fixtures each being a lighting fixture not secured by a hanging material when installed on a ceiling; connecting each of the connector-attached wirings provided in a ceiling rear space above the formed ceiling and a corresponding one of power supply adapters by using a connector of a corresponding one of the connector-attached wirings via an opening in a corresponding one of the ceiling materials; electrically connecting each of the lightweight large lighting fixtures and the power adapter, the plurality of the lightweight large lighting fixtures provided in a room space below the formed ceiling; passing a first lighting fixture, among the plurality of the lightweight large lighting fixtures electrically connected to the connector-attached wirings, through the openings in the ceiling materials to install a first lighting fixture on the ceiling materials; coupling a second lighting fixture, among the plurality of the lightweight large lighting fixtures electrically connected to the connector-attached wirings, with the first lighting fixture and passing the second lighting fixture through the openings of the ceiling materials to install the second lighting fixture, coupled with the first lighting fixture, on the ceiling materials; and adjusting a position of the first lighting fixture or the second lighting fixture installed on the ceiling materials, with respect to the ceiling materials within a predetermined range in which the first lighting fixture or the second lighting fixture are movable as the lightweight large lighting fixture.

Effects of Invention

According to the present disclosure, a lighting device in which adjacent lighting appliances appears continuous with inconspicuous boundary therebetween and a method for constructing a building can be provided.

DESCRIPTION OF EMBODIMENTS

Figure 1:
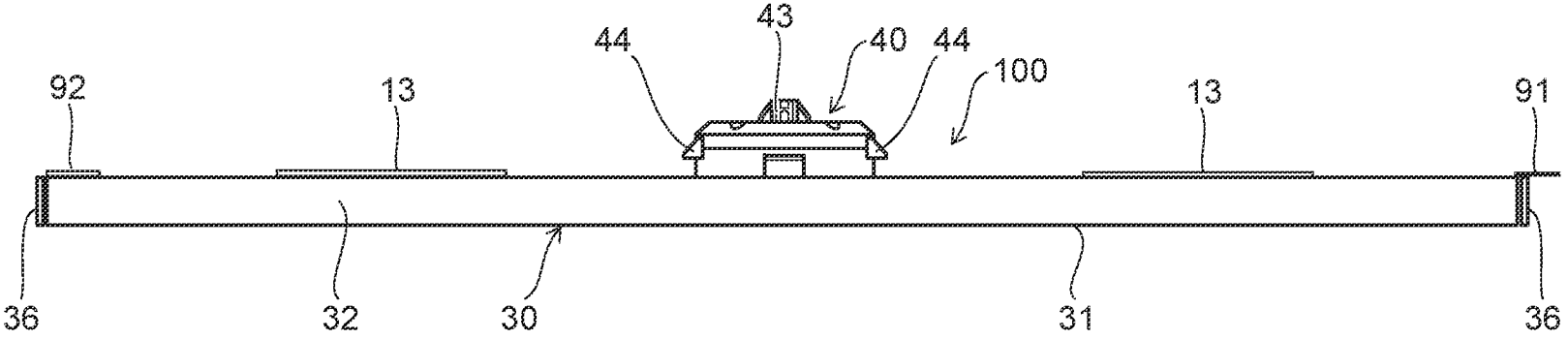
FIG. 1 is a side view of a lighting appliance according to one embodiment of the present invention.

Embodiments will be described below with reference to the drawings. In the drawings, the same elements are designated with the same reference signs.

Figure 2:
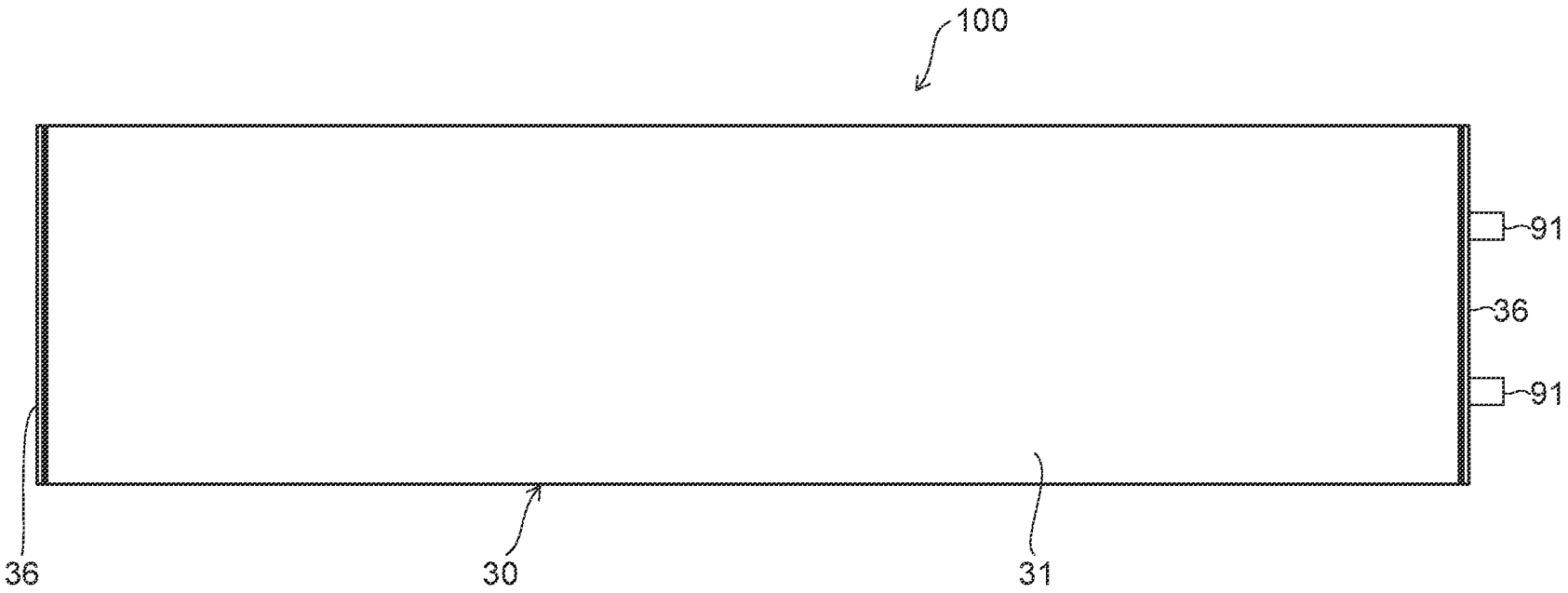
FIG. 2 is a plan view of a light emitting surface of the lighting appliance according to one embodiment of the present invention.
Figure 3:
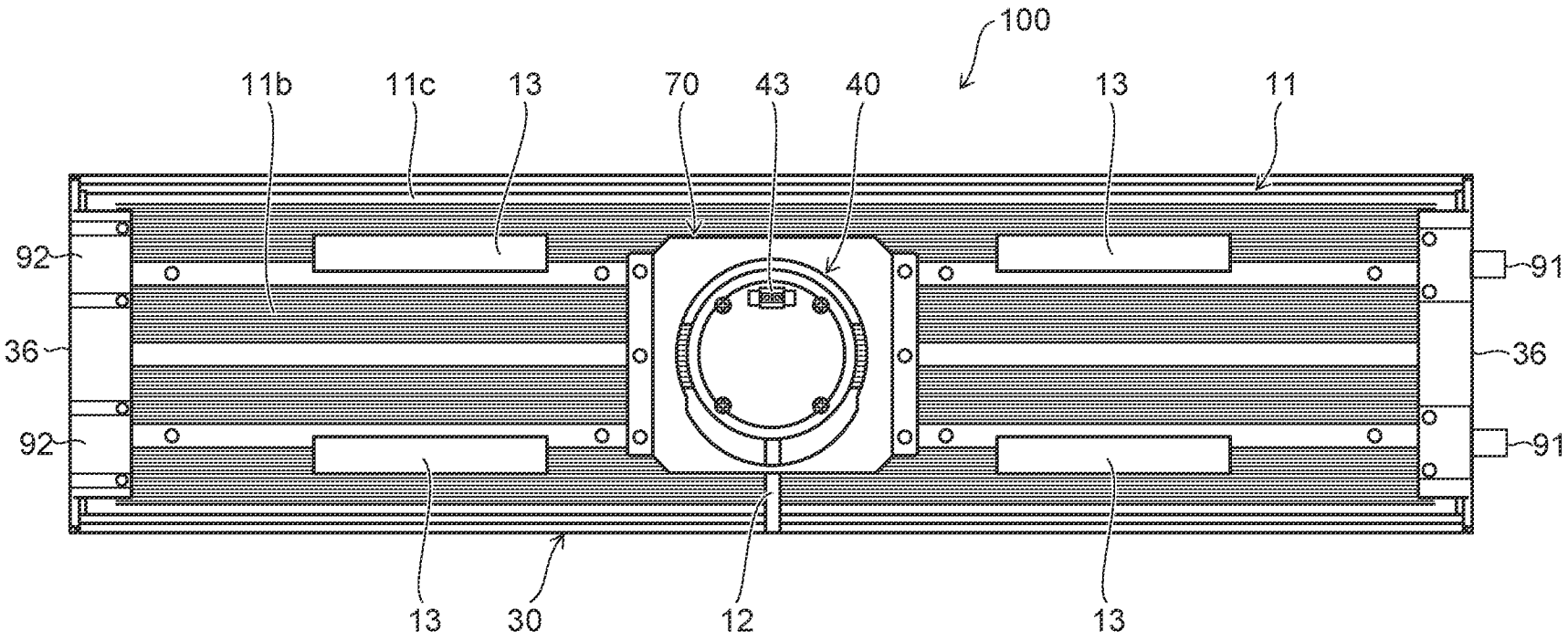
FIG. 3 is a plan view of a rear surface of the lighting appliance according to one embodiment of the present invention.
Figure 4:
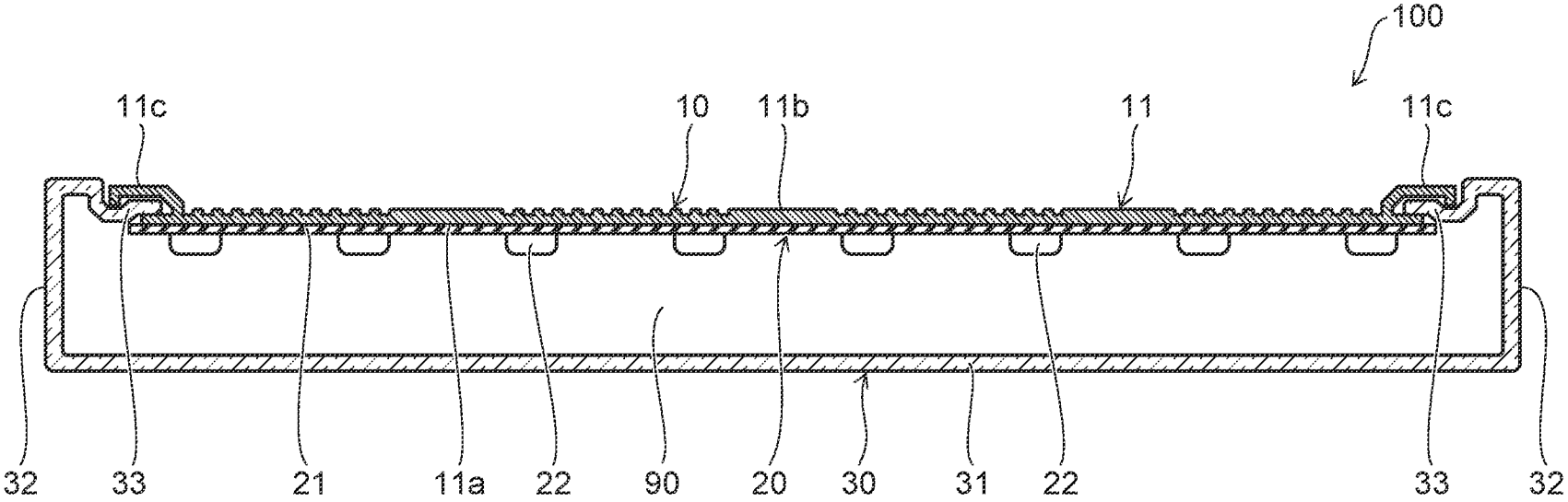
FIG. 4 is a cross-sectional view in a lateral direction of the lighting appliance according to one embodiment of the present invention.

FIG. 1 is a side view of a lighting appliance 100 according to one embodiment of the present invention. FIG. 2 is a plan view of a light emitting surface of the lighting appliance 100. FIG. 3 is a plan view of a rear surface of the lighting appliance 100. FIG. 4 is a cross-sectional view in the lateral direction of the lighting appliance 100.

The lighting appliance 100 has, for example, an outer shape of a rectangular shape, and includes a rectangular light emitting surface. The lighting appliance 100 includes a lighting appliance body 10, a light-transmitting cover 30, and a fitting adapter 40.

As illustrated in FIG. 4, the lighting appliance body 10 includes a chassis 11 and a light source module 20. The chassis 11 is preferably a metal plate, for example. The chassis 11 includes a light source placement surface 11*a* and a rear surface 11*b* on the opposite side of the light source placement surface 11*a*.

As illustrated in FIG. 3, the fitting adapter 40 is disposed on the rear surface 11*b* of the chassis 11. A lighting appliance-side connector 43 having a socket structure, for example, is fixed to an upper surface of the fitting adapter 40. Cushion materials 13 are provided on the rear surface 11*b* of the chassis 11.

As illustrated in FIG. 4, the light source module 20 is mounted to the light source placement surface 11*a* of the chassis 11. The light source module 20 is fastened, for example, with screws to the chassis 11. The chassis 11 functions as a reinforcing plate and a heat sink plate for the light source module 20. A plurality of recesses and protrusions extending in the longitudinal direction (the direction orthogonal to the plane of FIG. 4) of the rectangular chassis 11 are formed on the rear surface 11*b* of the chassis 11. These recesses and protrusions allow for increasing the surface strength of the chassis 11.

The light source module 20 includes a substrate 21 and a plurality of light sources 22. The rear surface of the substrate 21 is in contact with the light source placement surface 11*a* of the chassis 11. The plurality of light sources 22 are arranged periodically on a light source mounting surface (a surface on the opposite side of the rear surface in contact with the chassis 11) of the substrate 21. For example, the plurality of light sources 22 are arranged in a lattice with a uniform pitch.

Each of the light sources 22 includes, for example, a light emitting element such as a light emitting diode (LED). The light source 22 can further include a phosphor layer and a resin member. The lighting appliance-side connector 43 illustrated in FIG. 3 is electrically connected to the light sources 22 through a conductor pattern formed in the substrate 21.

The cover 30 is transmissive of light emitted from the light sources 22. For example, the cover 30 is formed of a resin material such as an acrylic resin with titanium oxide or the like dispersed in the resin material to diffuse light, and has a milky white color. The cover 30 is supported by the lighting appliance body 10 so as to cover the light sources 22.

As illustrated in FIG. 4, the cover 30 has a main surface portion 31 that faces the light sources 22 across a space 90. The main surface portion 31 has a rectangular shape. Corresponding to four sides of the main surface portion 31, the cover 30 has four lateral surface portions to cover lateral sides of the space 90. FIG. 4 illustrates two lateral surface portions 32 provided in the longitudinal direction of the main surface portion 31.

Side caps 36 illustrated in FIGS. 1 to 3 are fitted to both ends of the cover 30 in the longitudinal direction of the cover 30. The side caps 36 form lateral surface portions in the lateral direction of the cover 30.

As illustrated in FIG. 4, the cover 30 further includes upper side portions 33. The main surface portion 31, the lateral surface portions 32 in the longitudinal direction, and the upper side portions 33 are integrally formed, for example, by extrusion molding. The lateral surface portions 32 are located outward of outer edges of the lighting appliance body 10 in the longitudinal direction of the lighting appliance body 10 and extend to a location above the light source module 20.

The upper side portions 33 are continuous with the upper ends of the lateral surface portions 32 and protrude from the lateral surface portions 32 toward the chassis 11. The lateral surface portions 32 and the upper side portions 33 extend in the longitudinal direction of the cover 30 (the direction orthogonal to the plane of FIG. 4). In a state in which the side caps 36 are absent, both ends of the cover 30 in the longitudinal direction are open.

Cover insertion portions 11*c* are provided on both end portions in the lateral direction (the left-right direction in FIG. 4) of the rear surface 11*b* of the chassis 11. The cover insertion portions 11*c* project outward of the chassis 11 to form gaps between the cover insertion portions 11*c* and the rear surface 11*b* of the chassis 11. The upper side portions 33 of the cover 30 are inserted into the gaps below the cover insertion portions 11*c*. The cover insertion portions 11*c* and the gaps below the cover insertion portions 11*c* extend in the longitudinal direction of the chassis 11 (the direction orthogonal to the plane of FIG. 4).

Before fitting the side caps 36, the chassis 11 and the cover 30 are slid relative to each other in the longitudinal direction to insert the upper side portions 33 of the cover 30 into the gaps below the cover insertion portions 11*c* of the chassis 11. The upper side portions 33 of the cover 30 are placed on the end portions of the rear surface 11*b* of the chassis 11 in the longitudinal direction, and the cover 30 is supported with respect to the lighting appliance body 10. After this, the side caps 36 are fitted to both ends of the cover 30 in the longitudinal direction.

Figure 5:
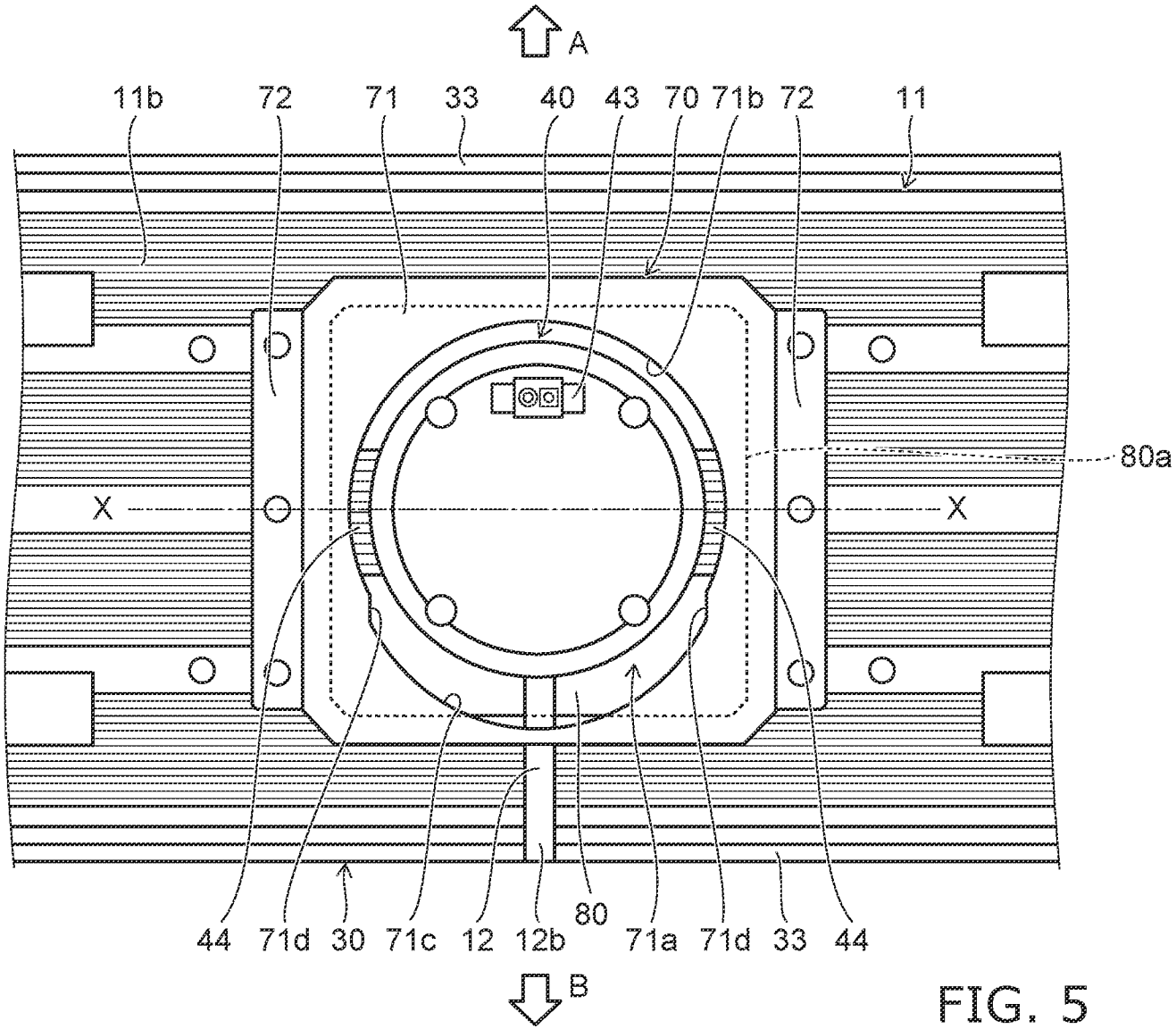
FIG. 5 is an enlarged view of a portion in FIG. 3.
Figure 6:
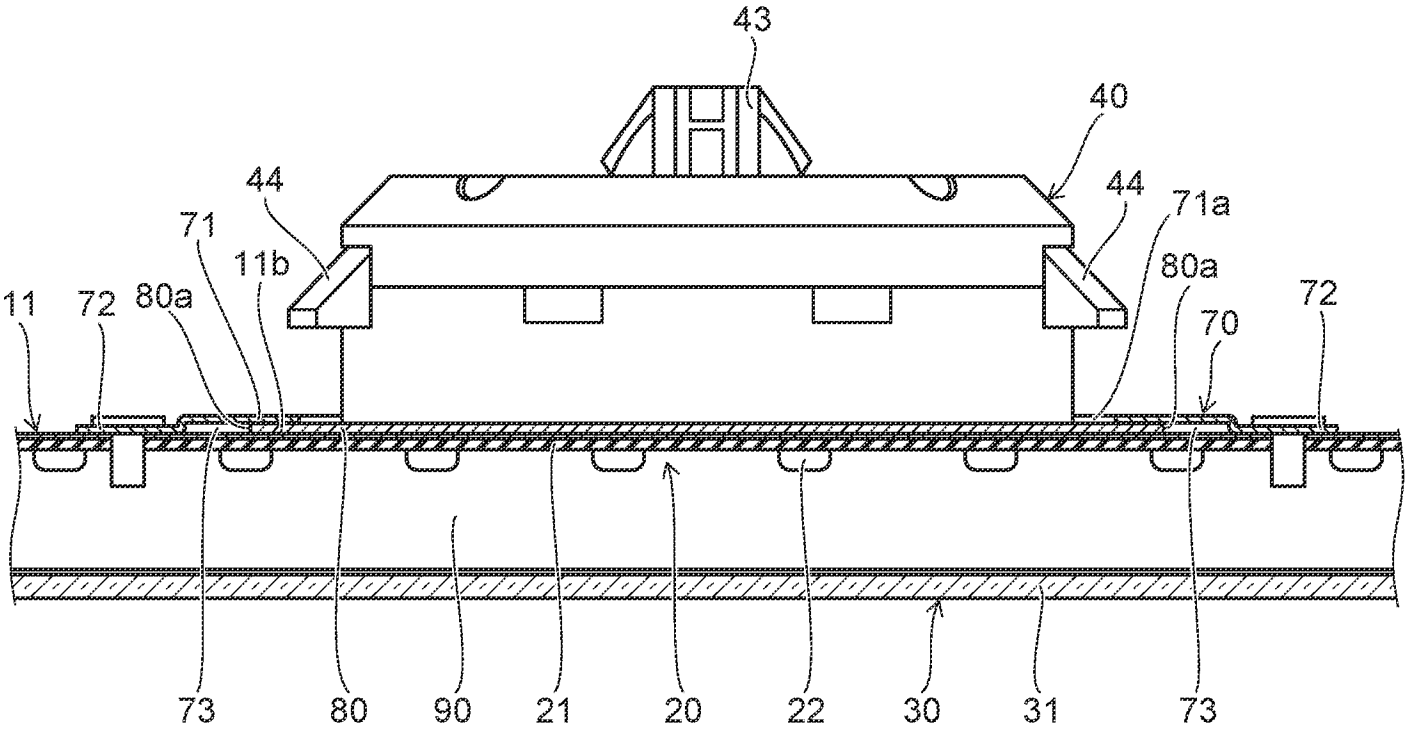
FIG. 6 is a cross-sectional view taken along line X-X in FIG. 5.

FIG. 5 is an enlarged view of a portion in FIG. 3 (the portion where the fitting adapter 40 is provided). FIG. 6 is a cross-sectional view taken along the line X-X in FIG. 5.

As illustrated in FIG. 6, the fitting adapter 40 is secured on an adapter securing member 80. The fitting adapter 40 is fastened, for example, with screws to the adapter securing member 80. The adapter securing member 80 is, for example, an aluminum plate.

An adapter holding member 70 is secured to the rear surface 11*b* of the chassis 11. The adapter holding member 70 is, for example, an electrogalvanized steel plate.

The adapter holding member 70 has a lower stepped portion 72 and an upper stepped portion 71. The lower stepped portion 72 is fastened, for example, with screws to the chassis 11. The upper stepped portion 71 is located farther from the rear surface 11*b* of the chassis 11 than the lower stepped portion 72, and a space is defined between the upper stepped portion 71 and the rear surface 11*b* of the chassis 11. The adapter securing member 80 is disposed in this space.

The plate-like adapter securing member 80 has an outer periphery (outer shape) 80*a* that is represented by the dashed line in FIG. 5. As illustrated in FIG. 6, a gap 73 is formed between the outer periphery 80*a* of the adapter securing member 80 and the lower stepped portion 72 of the adapter holding member 70. The space between the upper stepped portion 71 and the rear surface 11*b* of the chassis 11 is open in a direction orthogonal to the plane of FIG. 6.

As illustrated in FIG. 5, an opening 71*a* is formed in the upper stepped portion 71 of the adapter holding member 70. The fitting adapter 40 is located in the opening 71*a*. The outer periphery 80*a* of the adapter securing member 80 is located outward of the edge of the opening 71*a*. In the top view illustrated in FIG. 5, a portion of the adapter securing member 80 is hidden under the fitting adapter 40 and below the upper stepped portion 71 of the adapter holding member 70.

The opening 71*a* is defined by a first edge 71*b* and a second edge 71*c* that are connected via a straight-line portion 71*d*. The fitting adapter 40 has a cylindrical shape, and in this example, the first edge 71*b* is formed along the annular shape of the lateral surface of the fitting adapter 40. The second edge 71*c* protrudes downward (downward direction B) in FIG. 5 from the first edge 71*b* via the straight-line portion 71*d*.

As described below, an upward direction A in FIG. 5 is a direction (first direction) in which the lighting appliance body 10 is relatively moved with respect to the adapter securing member 80 together with the adapter holding member 70 when the fitting adapter 40 is detached from the ceiling material. The downward direction (second direction) B in FIG. 5 is a direction in which a detachment member 12 is pulled, which is operated in detaching the fitting adapter 40 from the ceiling material, after the lighting appliance body 10 has been moved in the upward direction (first direction) A (the state illustrated in FIG. 15).

As illustrated in FIG. 6, the adapter securing member 80 is disposed between the upper stepped portion 71 of the adapter holding member 70 and the rear surface 11*b* of the chassis 11 and is not secured to the chassis 11. That is, the fitting adapter 40 secured to the adapter securing member 80 and the lighting appliance body 10 are movable relative to each other in a direction parallel to the rear surface 11*b* of the chassis 11. The term "move" as used herein includes not only linear movement but also include rotational movement.

The gap 73 between the outer periphery 80*a* of the adapter securing member 80 and the lower stepped portion 72 of the adapter holding member 70 and the gap between the edge of the opening 71*a* formed in the upper stepped portion 71 and the lateral surface of the fitting adapter 40 allow relative movement of the lighting appliance body 10 with respect to the fitting adapter 40. Abutment between the outer periphery 80*a* of the adapter securing member 80 and the lower stepped portion 72 of the adapter holding member 70, and abutment between the lateral surface of the fitting adapter 40 and the edges of the opening 71*a* regulate the relative movement of the lighting appliance body 10 with respect to the fitting adapter 40.

Figure 7:
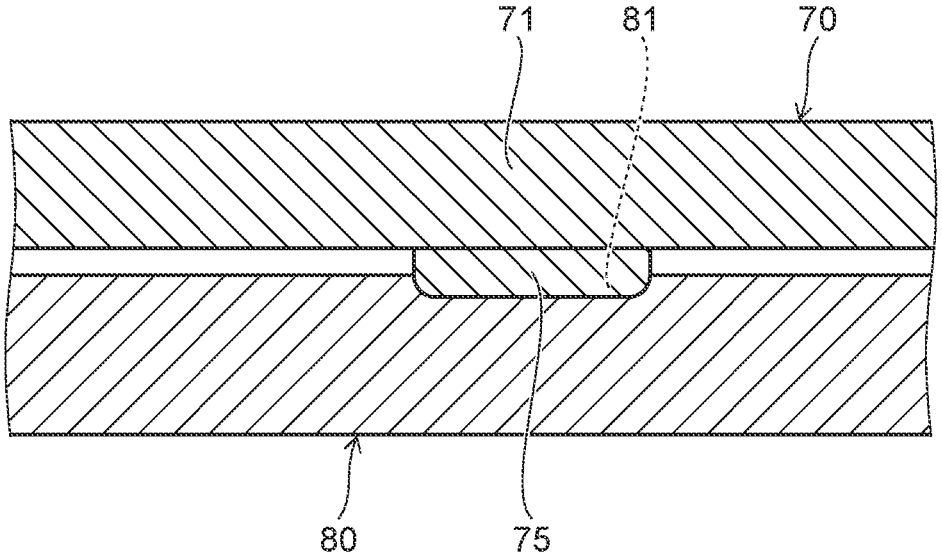
FIG. 7 is an enlarged view of a portion in FIG. 6.

As illustrated in FIG. 7, the lower surface of the upper stepped portion 71 of the adapter holding member 70 has a projecting portion 75, and the upper surface of the adapter securing member 80 has a recessed portion 81 configured to be engaged with the projecting portion 75 can fit. A plurality of the projecting portions 75 are formed in the upper stepped portion 71, and a plurality of the recessed portions 81 corresponding to the plurality of projecting portions 75 are formed in the adapter securing member 80.

In the initial position of the relative position of the fitting adapter 40 and the lighting appliance body 10, the projecting portions 75 are engaged with the recessed portions 81. In other words, when the lighting appliance body 10 is attached to the ceiling material via the fitting adapter 40 and adjustment in the position of the lighting appliance body 10 (the position in directions along the ceiling surface) is not needed, a state in which the projecting portions 75 are engaged with the recessed portions 81 is maintained.

After mounting, if adjustment in the position of the lighting appliance body 10 is necessary, the mounting position of the lighting appliance body 10 can be adjusted by sliding (and/or rotating) the lighting appliance body 10 in directions along the mounting surface (ceiling surface) from the initial position with respect to the fitting adapter 40 and the adapter securing member 80 secured to the ceiling material. The cover 30 attached to the lighting appliance body 10 is also moved together with the lighting appliance body 10 to perform adjustment in the position.

At this time, engagement between the projecting portions 75 and respective recessed portions 81 are released, and the projecting portions 75 come into contact with the upper surface of the adapter securing member 80. That is, the lighting appliance body 10 is supported by the adapter securing member 80 secured to the ceiling material in the state of point-contact, in which the plurality of projecting portions 75 are in contact with the upper surface of the adapter securing member 80. When the adapter holding member 70 and the adapter securing member 80 are in point contact, the frictional force between the adapter holding member 70 and the adapter securing member 80 is smaller than that in the case of surface contact, so that relative movement between the adapter holding member 70 and the adapter securing member 80 is facilitated.

According to the present embodiment, the fitting adapter 40 and the lighting appliance body 10 are relatively movable instead of securing the fitting adapter 40 to the lighting appliance body 10. With such a structure, after attachment to the ceiling material, the position of the lighting appliance body 10 can be adjusted by an allowance for positional adjustment, the allowance formed by the gap 73 between the outer periphery 80*a* of the adapter securing member 80 and the lower stepped portion 72 of the adapter holding member 70 and the gap between the edge of the opening 71*a* formed in the upper stepped portion 71 and the lateral surface of the fitting adapter 40.

Thus, even if variations in the positions of a plurality of mounting holes formed in the ceiling material occur when arranging a plurality of the lighting appliance bodies 10 to be aligned with each other, the plurality of lighting appliance bodies 10, that is, the light emitting surfaces, can be evenly arranged seamlessly.

When the position of a mounting hole is displaced in the wall, the lighting appliance body 10 may not fit in the installation space by the wall. However, according to the present embodiment, the lighting appliance body 10 can be reliably seated in the installation space by the wall by setting the position of the mounting hole by the wall to such a position that the lighting appliance body 10 at the initial position is separated from the wall, and by moving the lighting appliance body 10 toward the wall side after mounting the lighting appliance body 10 to the ceiling material via the fitting adapter 40.

The cushion materials 13 illustrated in FIG. 3 provided on the rear surface 11*b* of the chassis 11 are compressed between the rear surface 11*b* of the chassis 11 and the ceiling surface, and the lighting appliance body 10 is in close contact with the ceiling surface via the cushion materials 13. The frictional force between the cushion materials 13 and the ceiling surface maintains the position of the lighting appliance body 10 in directions along the ceiling. A force against the frictional force can be applied to the lighting appliance body 10 to move the lighting appliance body 10 to adjust the position of the lighting appliance body 10.

The allowable range of the relative movement of the lighting appliance body 10 with respect to the fitting adapter 40 is determined by the size of the gap 73 between the outer periphery 80*a* of the adapter securing member 80 and the lower stepped portion 72 of the adapter holding member 70 and the size of the gap between the edge of the opening 71*a* formed in the upper stepped portion 71 and the lateral surface of the fitting adapter 40. A clearance by which the adapter securing member 80 does not interfere with the lower stepped portion 72 of the adapter holding member 70 is only required to be ensured between the adapter securing member 80 and the lower stepped portion 72 when the fitting adapter 40 is moved within the range of the opening 71*a* formed in the adapter holding member 70.

Next, the mounting structure and the method of attaching the fitting adapter 40 to the ceiling material will be described. The fitting adapter 40 is attached to the ceiling material by a mounting bracket.

Figure 8:
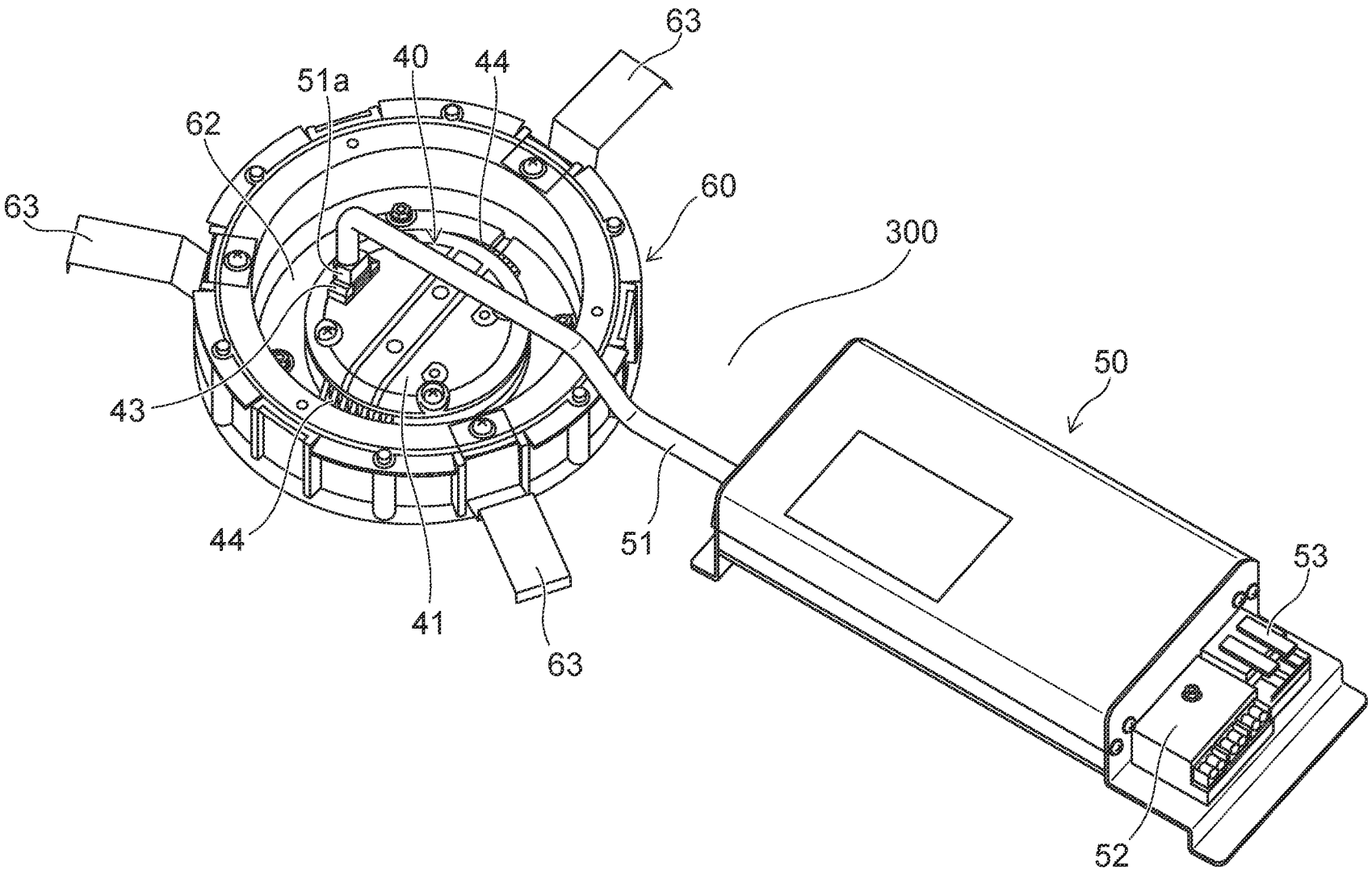
FIG. 8 is a perspective view of elements located on a rear side of a ceiling material in the lighting appliance according to one embodiment of the present invention.
Figure 9:
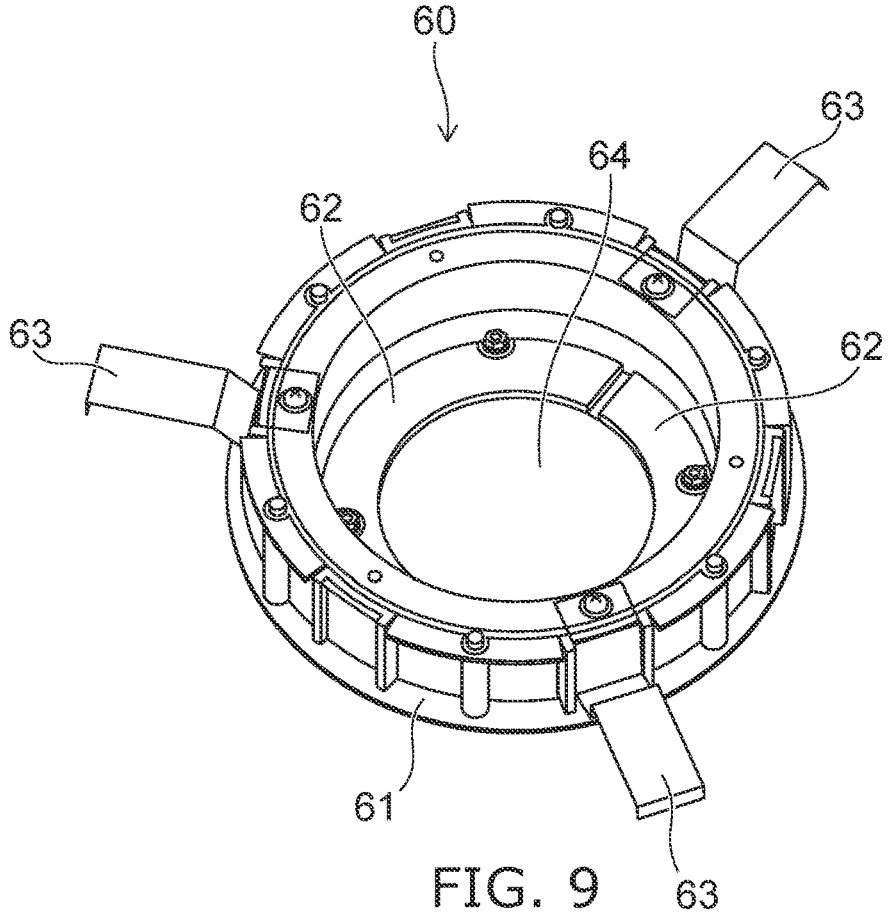
FIG. 9 is a perspective view of a mounting bracket used for attaching the lighting appliance according to one embodiment of the present invention to the ceiling material.
Figure 10:
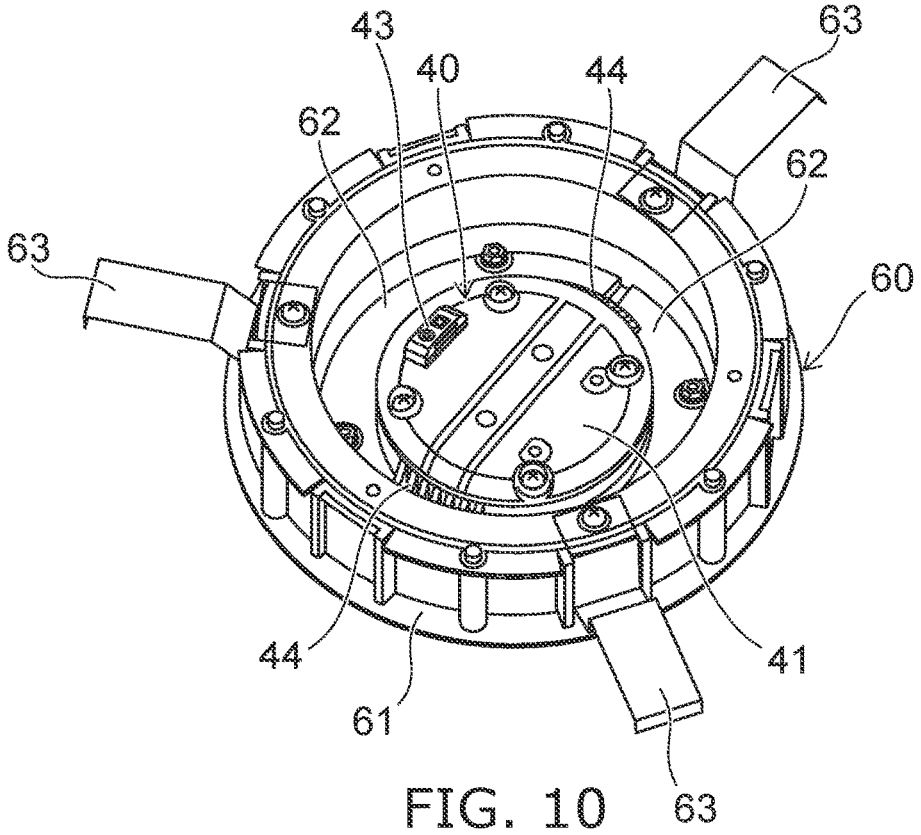
FIG. 10 is a perspective view illustrating a fitting structure of the mounting bracket and a fitting adapter according to one embodiment of the present invention.
Figure 11:
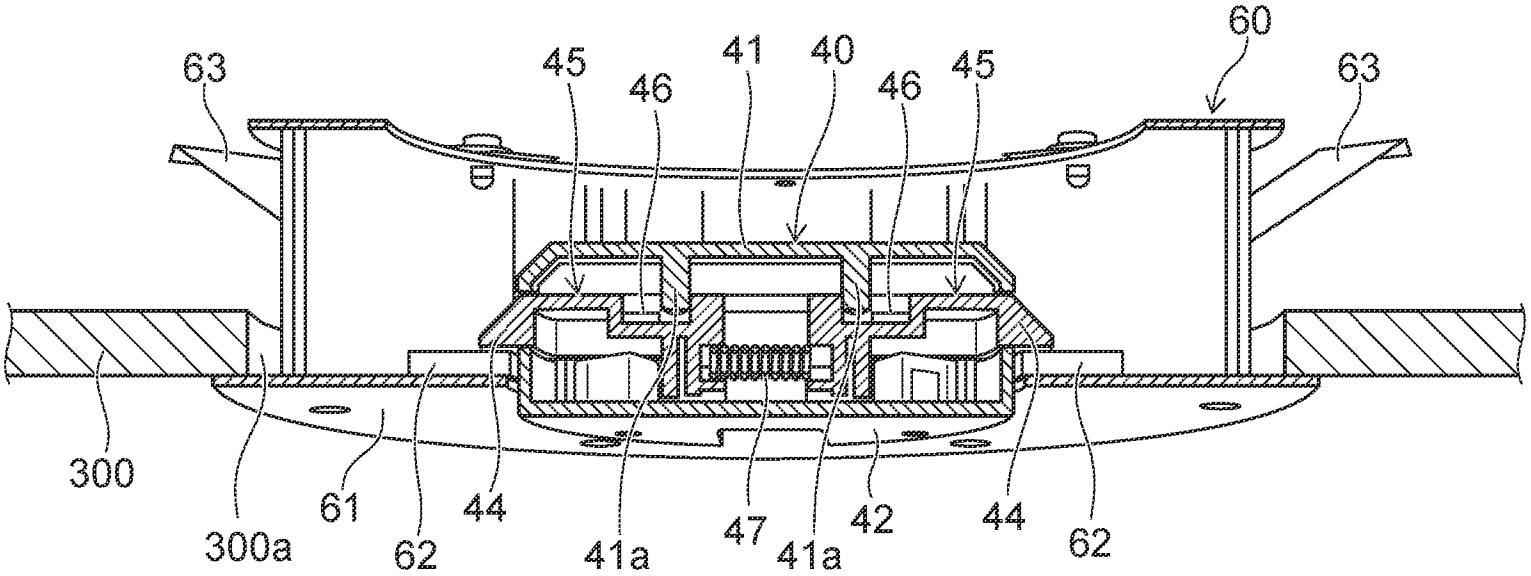
FIG. 11 is a cross-sectional perspective view illustrating a fitting structure of the mounting bracket and the fitting adapter according to one embodiment of the present invention.

FIG. 8 is a perspective view of elements located on the rear side of a ceiling material 300 in the lighting appliance 100. FIG. 9 is a perspective view of a mounting bracket 60. FIG. 10 is a perspective view illustrating the fitting structure of the mounting bracket 60 and the fitting adapter 40. FIG. 11 is a cross-sectional perspective view illustrating the fitting structure of the mounting bracket 60 and the fitting adapter 40.

As illustrated in FIG. 9, the mounting bracket 60 is formed into an annular shape, and the inside of the mounting bracket 60 includes an opening 64. A plurality of mounting springs 63 each having a leaf spring structure are provided on a lateral surface of the mounting bracket 60. An annular flange 61 is provided on a lower surface of the mounting bracket 60. The outer diameter of the flange 61 is greater than the diameter of a circular mounting hole formed in the ceiling material 300. A bearing plate 62 is provided on the upper surface of the flange 61 along the edge of the opening 64.

The mounting bracket 60 is fitted into a mounting hole 300*a* (illustrated in FIG. 11) formed in the ceiling material 300. The mounting springs 63 are disposed between a lateral surface of the mounting bracket 60 and an inner wall of the mounting hole 300*a* of the ceiling material 300 in a state in which the mounting springs 63 are deformed from their natural state. Restoring force of the mounting springs 63 pushes the mounting bracket 60 upward to cause the upper surface of the flange 61 on the outer periphery side to be pressed against the front lateral surface of the ceiling material 300 (see FIG. 11). Accordingly, the mounting bracket 60 is held in a state of being fitted into the mounting hole 300*a*.

If necessary, a power supply unit 50 illustrated in FIG. 8 is disposed on the rear side of the ceiling material 300 before fitting the mounting bracket 60 into the mounting hole 300*a* of the ceiling material 300. The power supply unit 50 is passed from the mounting hole 300*a* to the rear side of the ceiling material 300 and is disposed at a position that does not overlap the mounting hole 300*a* on the rear side of the ceiling material 300.

In a case in which a power supply unit 50 is already installed on the rear side of the ceiling material 300 and is used as is, a power supply unit 50 need not be installed on the rear side of the ceiling material 300.

As illustrated in FIG. 8, the power supply unit 50 includes terminal stands 52 and 53 that is configured be connected to an external power supply (commercial power supply). An electrical cable 51 is extended from the power supply unit 50. The terminals of each of the terminal stands 52 and 53 are electrically connected to a circuit board of the power supply unit 50, and the electrical cable 51 is electrically connected to the circuit board. A power supply-side connector 51*a* is provided at an end portion of the electrical cable 51.

In a state before the lighting appliance body 10 is attached to the ceiling material 300, the electrical cable 51 is passed through the mounting hole 300*a* of the ceiling material 300 and the opening 64 inside of the mounting bracket 60 fitted into the mounting hole 300*a*, and the power supply-side connector 51*a* is positioned on the front side of the ceiling material 300.

A worker that performs the mounting work of the lighting appliance 100 brings the lighting appliance 100 closer to the ceiling material 300 and holds the power supply-side connector 51*a* of the electrical cable 51 that hangs from the mounting hole 300*a* with one hand while holding the lighting appliance 100 with the other hand.

Then, the worker connects the power supply-side connector 51*a* to the lighting appliance-side connector 43 fixed to the upper surface of the fitting adapter 40 provided on the rear surface of the lighting appliance body 10.

After the power supply-side connector 51*a* is connected to the lighting appliance-side connector 43, the fitting adapter 40 is fitted into the opening 64 on the inside of the mounting bracket 60, which is fitted into the mounting hole 300*a* of the ceiling material 300.

As illustrated in FIG. 11, the fitting adapter 40 includes an upper case 41, a lower case 42, two slide members 45, and a spring 47 connecting the two slide members 45.

A claw portion 44 with an inclined surface is provided on the tip end of each of the slide members 45. Sliding movement of the two slide members 45 generated by extension and contraction of the spring 47 causes the claw portions 44 to hook onto the insides of the cases 41 and 42 through an opening formed between the upper case 41 and the lower case 42, and to protrude outward of the cases 41 and 42.

FIG. 11 illustrates a state in which the claw portions 44 protrude to the outside of the cases 41 and 42 and ride on the upper surface of the bearing plate 62 of the mounting bracket 60. As illustrated in FIG. 11, stoppers 41*a* protruding downward from the upper case 41 are positioned in recessed portions 46 formed in the upper surface of the slide members 45, and abutment between the stoppers 41*a* and the wall surfaces of the recessed portions 46 restricts movement of the two slide members 45 in the direction of separating from each other.

In general, the claw portions 44 protrude outward from the cases 41 and 42. When the fitting adapter 40 is fitted inside the mounting bracket 60, the inner peripheral wall of the flange 61 and the inner peripheral wall of the bearing plate 62 of the mounting bracket 60 abut against the inclined surface of the claw portion 44. Due to the force acting on the claw portion 44 from the inner peripheral wall of the flange 61 and the inner peripheral wall of the bearing plate 62, the two slide members 45 slide toward each other while compressing the spring 47. Each claw portion 44 is recessed inside the cases 41 and 42 and allows the fitting adapter 40 to fit inside the mounting bracket 60.

Then, when the claw portion 44 is moved to a position above the bearing plate 62, the force acting on the claw portion 44 from the inner peripheral wall of the bearing plate 62 is released, and the two slide members 45 are biased in a direction separating from each other by the restoring force of the spring 47. The claw portions 44 protrude outward from the cases 41 and 42, and the lower surfaces of the claw portions 44 ride (get caught) on the upper surface of the bearing plate 62. With this structure, the fitting adapter 40 and the lighting appliance body 10 fixed with the fitting adapter 40 are prevented from falling out of the mounting bracket 60.

In a state in which the fitting adapter 40 is fitted into the mounting bracket 60, the cushion materials 13 provided on the rear surface 11*b* of the chassis 11 illustrated in FIG. 3 come into close contact with the front lateral surface of the ceiling material 300. The main surface portion 31 of the cover 30 is parallel to the surface of the front side of the ceiling material 300, and is directed toward a space below the ceiling material 300.

Alternatively, the lighting appliance 100 according to the embodiment can be attached to a wall material by using the same method as the method of attaching the lighting appliance 100 to the ceiling material 300. When the lighting appliance 100 is attached to a wall material, the main surface portion 31 of the cover 30 is parallel to the wall surface and is directed toward a side space of the wall material.

The fitting adapter 40 is provided on the rear surface 11*b* of the chassis 11. The plurality of light sources 22 in the light source module 20 are disposed on the light source placement surface 11*a* of the chassis 11 over a region larger than the area of the mounting hole 300*a* of the ceiling material 300 and the area of the opening 64 of the mounting bracket 60. The light sources 22 are also disposed in a region overlapping the fitting adapter 40 in the lighting appliance body 10. Thus, in the main surface portion 31 of the cover 30, the center portion, which is the region overlapping the mounting hole 300*a* and the fitting adapter 40, can also be illuminated, and a light emitting surface is obtained over a wide area.

Alternatively, the fitting adapter 40 may be provided on the light source placement surface 11*a* of the chassis 11, and an opening that allows the claw portions 44 of the fitting adapter 40 to protrude may be formed on the lateral surface of the cover 30. In this case, it is necessary to prevent light from leaking from the opening formed in the cover 30.

By installing a plurality of the lighting appliances 100 described above, a lighting device having a wider light emitting surface can be achieved. The plurality of lighting appliances 100 are provided adjacent to each other with the lateral surface portions of the covers 30 abutting against each other.

As illustrated in FIGS. 1 to 3, a first coupling member 91 and a second coupling member 92 are provided on the rear surface 11*b* of the chassis 11, and adjacent lighting appliances 100 are coupled by the coupling members 91 and 92.

The first coupling member 91 is a protruding portion that protrudes outward from the chassis 11 from one of short sides of the chassis 11. A plurality of (e.g., two) first coupling members 91 are provided spaced apart in the lateral direction of the chassis 11. Corresponding to the number of first coupling members 91, a plurality of (e.g., two) second coupling members 92 are provided on the other short side of the chassis 11 spaced apart in the lateral direction. The second coupling member 92 has a space into which the first coupling member 91 can be inserted. The second coupling member 92 does not protrude outward from the chassis 11. The first coupling member 91 and the second coupling member 92 are each made of, for example, an electrogalvanized steel plate.

Figure 12A:
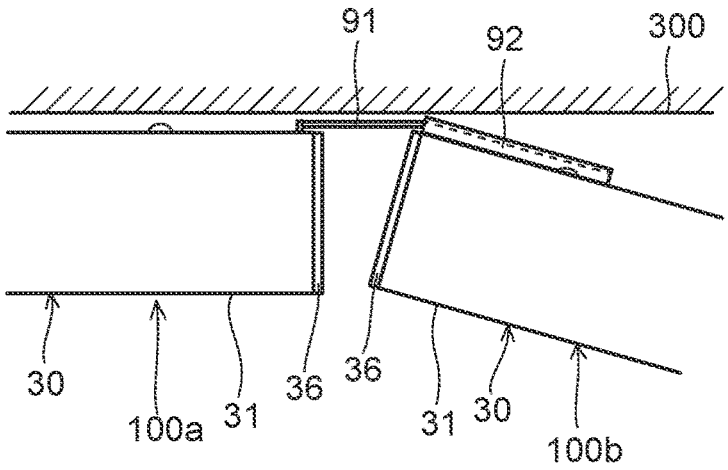
FIG. 12A is a schematic side view illustrating a method of coupling two lighting appliances according to one embodiment of the present invention.
Figure 12B:
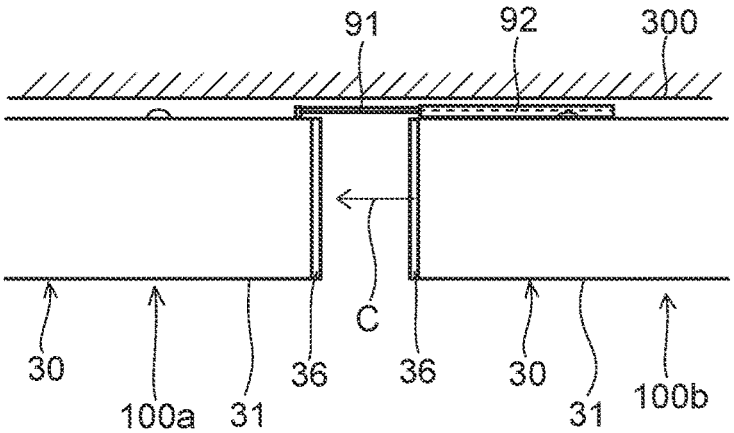
FIG. 12B is a schematic side view illustrating a method of coupling two lighting appliances according to one embodiment of the present invention.
Figure 12C:
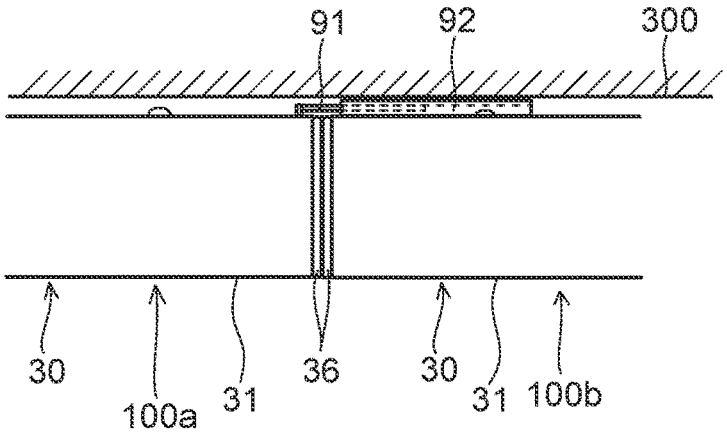
FIG. 12C is a schematic side view illustrating a method of coupling two lighting appliances according to one embodiment of the present invention.

FIGS. 12A to 12C are schematic side views illustrating a method of coupling two lighting appliances. One of the two adjacent lighting appliances is referred to as a first lighting appliance 100*a* and the other is referred to as a second lighting appliance 100*b*. The first lighting appliance 100*a* and the second lighting appliance 100*b* have the same configuration as that of the lighting appliance 100 described above.

The first lighting appliance 100*a* and the second lighting appliance 100*b* are arranged closely adjacent to each other with, for example, lateral surface portions (side caps 36 in this example) abutting against each other in the lateral direction. A lateral surface portion (side cap 36) on a side provided with one of the first coupling member 91 and the second coupling member 92 (the first coupling member 91 in this example) in the first lighting appliance 100*a* and a lateral surface portion (side cap 36) on a side provided with the other of the first coupling member 91 and the second coupling member 92 (the second coupling member 92 in this example) in the second lighting appliance 100*b* are closely adjacent to each other.

In FIG. 12A, the first lighting appliance 100*a* has been attached to the ceiling material 300. In other words, the fitting adapter 40 of the first lighting appliance 100*a* is fitted into the mounting hole 300*a* of the ceiling material 300 via the mounting bracket 60.

The fitting adapter 40 of the second lighting appliance 100*b* is fitted into the mounting bracket 60 having been fitted into the mounting hole 300*a* while the second coupling member 92 of the second lighting appliance 100*b* is aligned with respect to the first coupling member 91 of the first lighting appliance 100*a*. At this time, the tip portion of the first coupling member 91 of the first lighting appliance 100*a* is inserted into the space inside the second coupling member 92 of the second lighting appliance 100*b* while the second lighting appliance 100*b* is inclined relative to the ceiling surface.

As illustrated in FIG. 12B, the second lighting appliance 100*b* is attached to the ceiling material 300 with the side cap 36 of the second lighting appliance 100*b* spaced apart from the side cap 36 of the first lighting appliance 100*a*.

As described above, with the fitting adapter 40 of the second lighting appliance 100*b* attached to the ceiling material 300, the lighting appliance body 10 and the cover 30 of the second lighting appliance 100*b* are relatively movable with respect to the fitting adapter 40. That is, in the state of FIG. 12B, the lighting appliance body 10 and the cover 30 of the second lighting appliance 100*b* can move in a direction C to approach the first lighting appliance 100*a* in parallel to the ceiling surface.

The first coupling member 91 and the second coupling member 92 overlap on the rear surface 11*b* of the chassis 11 in a state in which the first coupling member 91 and the second coupling member 92 are relatively movable in directions parallel to the ceiling surface.

Then, by moving the lighting appliance body 10 and the cover 30 of the second lighting appliance 100*b* in the direction C, the side cap 36 of the second lighting appliance 100*b* is brought into abutment with the side cap 36 of the first lighting appliance 100*a*, so that the second lighting appliance 100*b* is closely adjacent to the first lighting appliance 100*a*, as illustrated in FIG. 12C. In this state, the first coupling member 91 of the first lighting appliance 100*a* and the second coupling member 92 of the second lighting appliance 100*b* are coupled on the rear surface 11*b* of the chassis 11. Specifically, the first coupling member 91 is inserted into the space inside the second coupling member 92, and the first coupling member 91 and the second coupling member 92 overlap each other between the lighting appliances 100*a* and 100*b* and the ceiling material 300.

The first coupling member 91 and the second coupling member 92 overlap on the rear side of the light source placement surface (between the chassis 11 and the ceiling surface) and are not located in the space inside the cover 30. Thus, the first coupling member 91 and the second coupling member 92 do not appear as a shadow from the main surface portion 31 and the lateral surface portions of the cover 30.

Such coupling between the first coupling member 91 and the second coupling member 92 can restrict a step (misalignment) in a direction perpendicular to the mounting surface (the ceiling surface in this example) at the adjacent portion between the first lighting appliance 100*a* and the second lighting appliance 100*b*. Thus, even if there is, for example, distortion or the like in the ceiling surface, or even if the lateral surface portion further from the fitting adapter 40 is easily displaced downward due to gravity, a step does not generate at the adjacent portion between the first lighting appliance 100*a* and the second lighting appliance 100*b*. That is, it is possible to bring a sense of unity to the adjacent lighting appliances 100*a* and 100*b* while achieving an inconspicuous joint between the light emitting surfaces of the adjacent lighting appliances 100*a* and 100*b*.

As illustrated in FIGS. 1 to 3, the lighting appliance 100 provided with the first coupling member 91 and the second coupling member 92 on both ends in the longitudinal direction can be used as the lighting appliance 100 disposed intermediate (between other lighting appliances 100) in a case in which three or more lighting appliances 100 are adjacent.

The lighting appliance 100 illustrated in FIGS. 1 to 3 can be used as the lighting appliance 100 on the left end of the plurality of adjacent lighting appliances 100. In this case, while the first coupling member 91 of another lighting appliance 100 is not inserted into the second coupling member 92 provided on the left end of the lighting appliance 100 on the left end, the second coupling member 92 does not protrude toward the side of the lighting appliance 100, and thus the second coupling member 92 does not spoil the appearance.

When the lighting appliance 100 illustrated in FIGS. 1 to 3 does not include the first coupling member 91 on the right end in the drawings, the lighting appliance 100 can be used as the lighting appliance 100 on the right end of the plurality of adjacent lighting appliances 100.

Alternatively, when the first coupling member 91 is detachably attached to the rear surface 11*b* of the chassis 11 by, for example, being fastened with screws, and the first coupling member 91 is detached from the lighting appliance 100 used on the right end, the first coupling member 91 can be prevented from protruding toward the side from the lighting appliance 100 disposed on the right end. Alternatively, instead of detaching the first coupling member 91, the first coupling member 91 may be reoriented and reattached to the rear surface 11*b* of the chassis 11 to conceal the first coupling member 91 behind the chassis 11.

Alternatively, the first coupling member 91 (or the second coupling member 92) can be disposed on the long side of the lighting appliance 100 at the end portion (a portion close to the short side) in the longitudinal direction and coupled with the second coupling member 92 (or the first coupling member 91) disposed on the short side of another lighting appliance 100, which allows the two lighting appliances 100 each having a rectangular shape to be adjacent to each other at a right angle in a plan view.

A single first coupling member 91 and a single second coupling member 92 may be provided in a single lighting appliance. In a case in which a plurality of first coupling members 91 and a plurality of second coupling members 92 are provided in a single lighting appliance, the misalignment in the rotational directions of the first lighting appliance 100*a* and the second lighting appliance 100*b* in the plane parallel to the mounting surface can be also regulated by the coupling of the plurality of first coupling members 91 and the plurality of second coupling members 92.

As illustrated in FIG. 5, a detachment member 12 is disposed on the rear surface 11*b* of the chassis 11. An end portion of the detachment member 12 is coupled to the slide members 45 of the fitting adapter 40.

Figure 13:
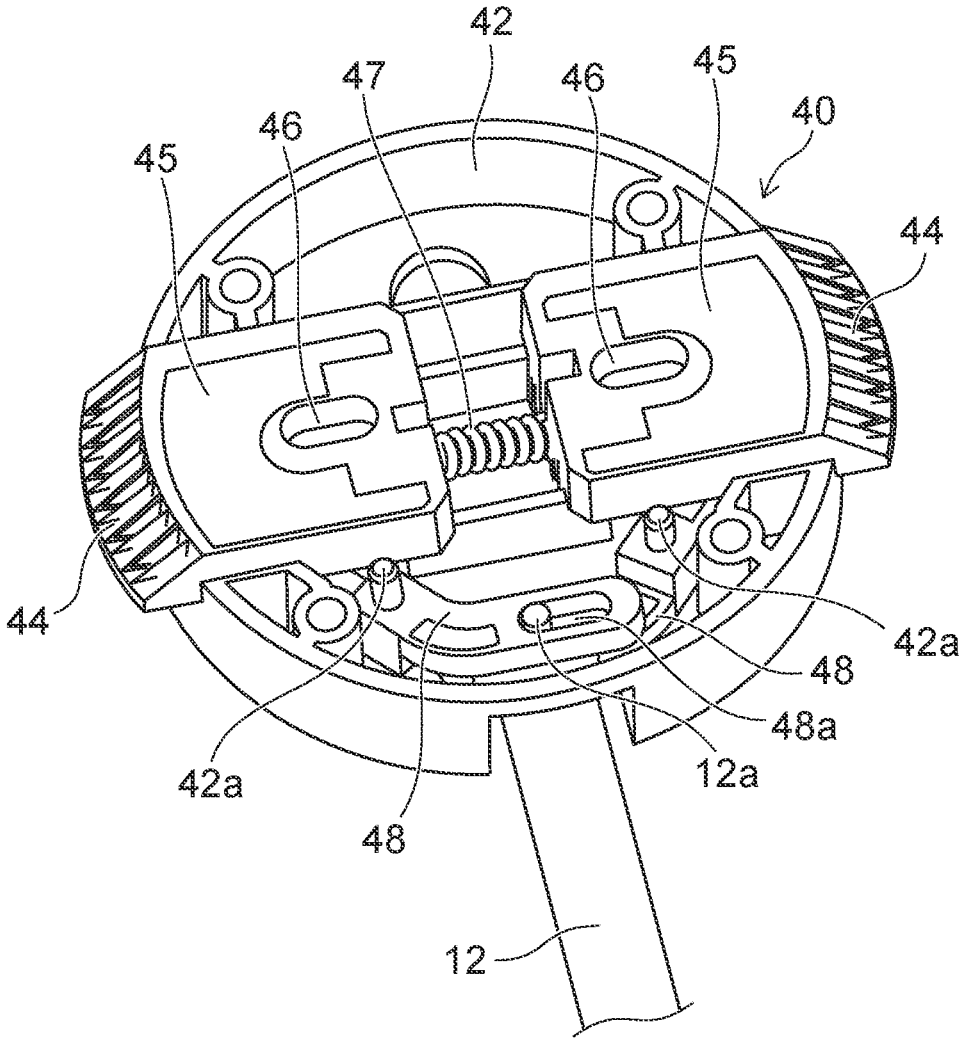
FIG. 13 is a perspective view illustrating a coupling structure of the fitting adapter and a detachment member according to one embodiment of the present invention.
Figure 14:
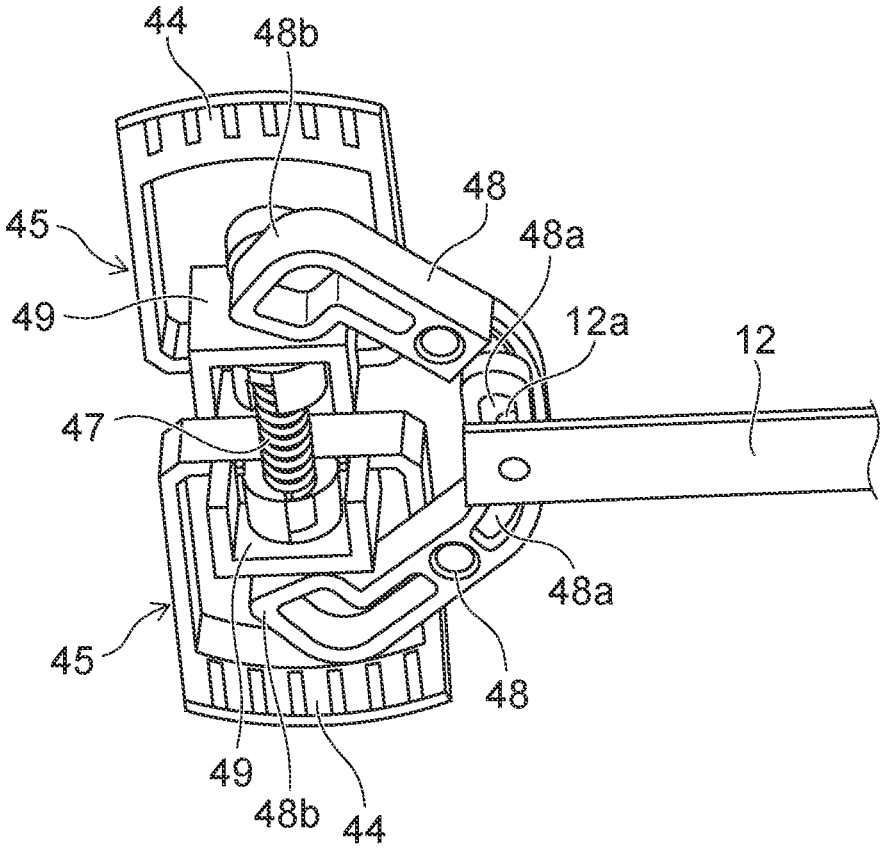
FIG. 14 is a perspective view illustrating a coupling structure of the fitting adapter and the detachment member according to one embodiment of the present invention.

FIGS. 13 and 14 are perspective views illustrating the coupling structure of the fitting adapter 40 and the detachment member 12. FIG. 13 illustrates a state in which the upper case 41 of the fitting adapter 40 is detached. FIG. 14 is a perspective view of the coupling structure of the detachment member 12 and the slide members 45 viewed from the rear side in which the lower case 42 is also detached from the state in FIG. 13.

The detachment member 12 and the slide members 45 are connected via two arm members 48. Each arm member 48 can rotate around a shaft portion 42*a* as a fulcrum provided in the lower case 42.

A through hole 48*a* is formed in one end portion of each of the arm members 48, and the through holes 48*a* of different arm members 48 are overlapped. A pin 12*a* provided at one end portion of the detachment member 12 is engaged in the through holes 48*a*.

When a worker pulls the other end portion 12*b* (illustrated in FIG. 5) of the detachment member 12 with, for example, a jig or fingers directly, the detachment member 12 can be slid in the longitudinal direction of the detachment member 12.

When the detachment member 12 is pulled in a direction in which the other end portion 12*b* of the detachment member 12 protrudes outward of the lateral surface of the lighting appliance 100, the pair of arm members 48 engaged with the pin 12*a* of the detachment member 12 rotate around the shaft portion 42*a* serving as the fulcrum. The rotation of the arm members 48 causes other end portions 48*b* of the arm members 48 illustrated in FIG. 14 to push protruding portions 49 provided on the lower surface of the slide members 45. Thus, the two slide members 45 compress the spring 47 and slide in directions approaching each other.

Due to the sliding movement of the slide members 45, the state in which the claw portions 44 ride on the bearing plate 62 of the mounting bracket 60 illustrated in FIG. 11 is released, the fitting adapter 40 is detached from the mounting bracket 60, and the lighting appliance body 10 can be detached from the ceiling material 300.

In a state in which the lighting appliance body 10 is attached to the ceiling material, that is, in a state in which the fitting adapter 40 is attached to the ceiling material via the mounting bracket 60, the other end portion 12*b* of the detachment member 12 overlaps the lighting appliance as illustrated in FIG. 5. In the example illustrated in FIG. 5, the other end portion 12*b* of the detachment member 12 overlaps an upper side portion 33 of the cover 30. In this state, the lighting appliance remains installed on the ceiling material and is used. That is, the detachment member 12 is not visible from the light emitting surface side.

Figure 15:
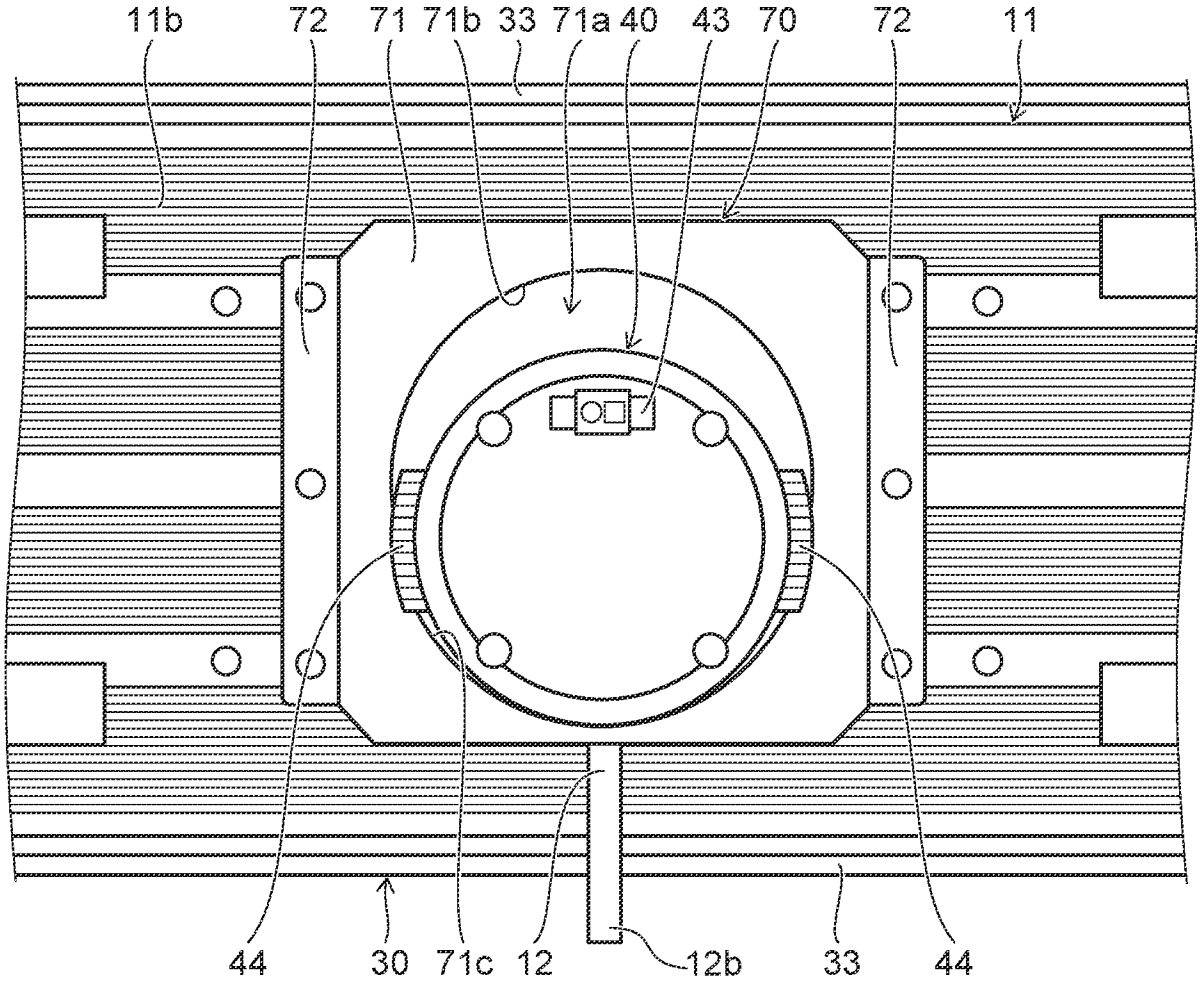
FIG. 15 is a plan view similar to FIG. 5 for describing an operation of detaching the lighting appliance according to one embodiment of the present invention.

By moving the lighting appliance body 10 in the state of FIG. 5 in the first direction A with respect to the fitting adapter 40 and the adapter securing member 80, the other end portion 12*b* of the detachment member 12 protrudes outward from the lateral surface of the lighting appliance (the lateral surface of the cover 30), as illustrated in FIG. 15. Then, by holding the protruding other end portion 12*b* with a jig or hand and moving the detachment member 12 in the second direction B opposite the first direction A, the claw portions 44 of the fitting adapter 40 disengage from the mounting bracket 60.

In the state of FIG. 5, the separation distance along the second direction B between the lateral surface facing the second direction B of the fitting adapter 40 and the edge 71*c* of the opening 71*a* formed in the adapter holding member 70 is greater than the separation distance along the first direction A between the lateral surface facing the first direction A of the fitting adapter 40 and the edge 71*b* of the opening 71*a* formed in the adapter holding member 70. Even when the lighting appliance body 10 is moved in the second direction B from the state illustrated in FIG. 5, the detachment member 12 remains hidden behind the lighting appliance.

With such a configuration, the direction in which the lighting appliance body 10 is moved for detachment can be defined in the one direction A, which allows for giving a clear operation instruction to the worker.

The width of the first coupling member 91 described above (the width in the direction orthogonal to the protrusion direction) is smaller than the width of the space inside the second coupling member 92, and the first coupling member 91 and the second coupling member 92 are movable relative to each other in the lateral direction of the lighting appliances 100*a* and 100*b* (the direction orthogonal to the plane of FIG. 12C) in a state in which the first coupling member 91 is inserted into the space inside the second coupling member 92.

Thus, even in a state in which a plurality of the lighting appliances 100 are coupled by the first coupling members 91 and the second coupling members 92, only the lighting appliance body 10 (and the cover 30) of the lighting appliance 100 to be detached can be slid in the first direction A in FIG. 5, so that the lighting appliance 100 to be detached can singly be detached from the ceiling material. A lighting appliance 100 coupled to the lighting appliance 100 to be detached is not moved in the first direction A together with the lighting appliance 100 to be detached.

According to the embodiment described above, an angular hole matching the shape and size of the lighting appliance body 10 is not needed be formed into the building material (ceiling material or wall material), and, formation of one mounting hole matching the size of the fitting adapter 40 and being smaller than the size of the lighting appliance body 10 allows mounting to the building material. Then, by fitting the fitting adapter 40 into the mounting bracket 60 fitted into the mounting hole, the lighting appliance body 10 can be easily attached to the building material.

The lighting appliance-side connector 43 is fixed to the upper surface of the fitting adapter 40 instead of hanging while connected to one end of the cable. On the other hand, the power supply-side connector 51*a* is lead out from the power supply unit 50 by the electrical cable 51. Accordingly, the power supply-side connector 51*a* is passed through the mounting hole 300*a* of the ceiling material 300 and the opening 64 of the mounting bracket 60 and positioned in proximity to the worker's hand at the front side of the ceiling material 300, and the worker can connect the power supply-side connector 51*a* to the lighting appliance-side connector 43 while gripping the power supply-side connector 51*a* with one hand and putting the other hand on the main surface portion 31 of the cover 30 to support the lighting appliance 100. It is not necessary that the lighting appliance-side connector 43 is directly gripped by a hand. Thus, even if the planar size of the lighting appliance body 10 increases, one worker can easily perform electrical connection between the power supply unit 50 and the lighting appliance 100 and mount the lighting appliance 100 to the ceiling material 300.

Also to detach the lighting appliance 100 from the ceiling material 300, by putting one hand on the main surface portion 31 of the lighting appliance 100 to support the lighting appliance 100 and pulling the other end portion 12*b* of the detachment member 12 described above with the other hand, for example, using a jig, engagement between the claw portions 44 of the fitting adapter 40 and the mounting bracket 60 can be released, so that the lighting appliance 100 can be detached from the ceiling material 300. After this, while still supporting the lighting appliance 100 with one hand, the power supply-side connector 51*a* can be detached from the lighting appliance-side connector 43 by moving the other hand from the detachment member 12 to the power supply-side connector 51*a* and pulling the power supply-side connector 51*a*. In other words, detachment of the lighting appliance 100 from the ceiling material 300 and release of the electrical connection between the power supply unit 50 and the lighting appliance 100 can be easily performed by a single worker.

According to such an embodiment, a variety of kinds of lighting appliance bodies 10 can be easily connected to a common power supply unit 50 with one operation, and thus changing to other kinds of lighting appliance bodies 10 can be performed easily. When changing the lighting appliance body 10, the common power supply unit 50 does not need to be detached from the ceiling material 300.

When a plurality of the lighting appliances 100 are closely adjacent to each other with respective lateral surface portions abutting against each other, the adjacent lateral surface portions are more likely to be brighter than other regions due to interference of light from the respective lighting appliances. Lateral surface portions (side caps 36) having a thickness in the cover 30 may each function like a light guide plate.

A region between a plurality of light sources 22 is illuminated by light from the plurality of light sources 22, whereas a region outward of the light source 22 disposed on the edge on the substrate 21 tends to be relatively dark due to light irradiation from one side. As the abutting portions of the lateral surface portions become relatively bright, the dark portion in the peripheral region of the of the substrate 21 becomes noticeable, and contrast is formed near the adjacent portions of the lighting appliances 100, which hinders uniformity of brightness in the light emitting surface.

Therefore, in the present embodiment, the light transmittance of the side caps 36, which are the adjacent portions (lateral surface portions) of the lighting appliances 100, is appropriately controlled.

Figure 16:
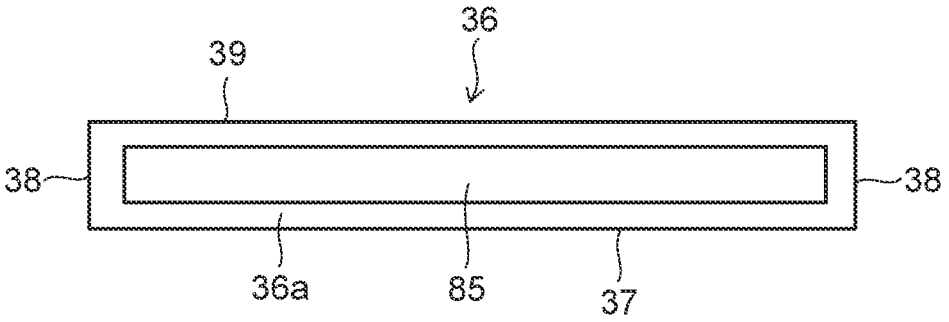
FIG. 16 is an inner view of a side cap in the lighting appliance according to one embodiment of the present invention.

FIG. 16 is an inner view of the side cap 36.

A transmittance control member 85 having a lower light transmittance than that of the side caps 36 is provided on an inner surface 36*a* facing the space inside the cover 30 in each side cap 36. The "light transmittance" as used herein represents transmittance to light emitted by the light sources 22.

Transmission of light is reduced in a region where the transmittance control member 85 is provided, which allows for hindering the abutting portions of the side caps 36 of the adjacent lighting appliances 100 from becoming excessively bright.

The transmittance control member 85 has light-shielding properties and/or reflective properties. In particular, when the transmittance control member 85 is a reflective member, the light reflected by the transmittance control member 85 illuminates a region outward of the outermost light source 22 on the substrate 21, and it is possible to suppress the occurrence of dark parts in the region.

Examples of the transmittance control member 85 having such reflective properties include a metal member and a white resin member. Among them, when a white resin member including a light diffusing material such as titanium oxide is used as the transmittance control member 85, luminance unevenness in the region near the adjacent portions of the lighting appliances 100 can be reduced due to the diffuse-reflecting properties.

In a case in which the transmittance control member 85 has reflective properties, when the transmittance control member 85 is provided to the end (edge) of the inner surface 36*a* of the side cap 36, a bright line may be generated at the end. Thus, as illustrated in FIG. 16, the transmittance control member 85 is separated from an end 37 on the main surface portion 31 side and a side end 38 that is continuous with the end 37 on the main surface portion 31 side in the inner surface 36*a* of the side cap 36. An end 39 on the mounting surface (for example, the ceiling surface) side is located behind the light sources 22, so that the transmittance control member 85 may be in contact with the end 39 on the mounting surface side.

The light transmittance of the side cap 36 is equal to or less than the light transmittance of the main surface portion 31 of the cover 30. Thus, transmission of light in the region where the transmittance control member 85 is not provided in the inner surface 36*a* of the side cap 36 can be reduced, and the abutting portions of the side caps 36 of the adjacent lighting appliances 100 are inhibited from becoming excessively bright.

Figure 17A:
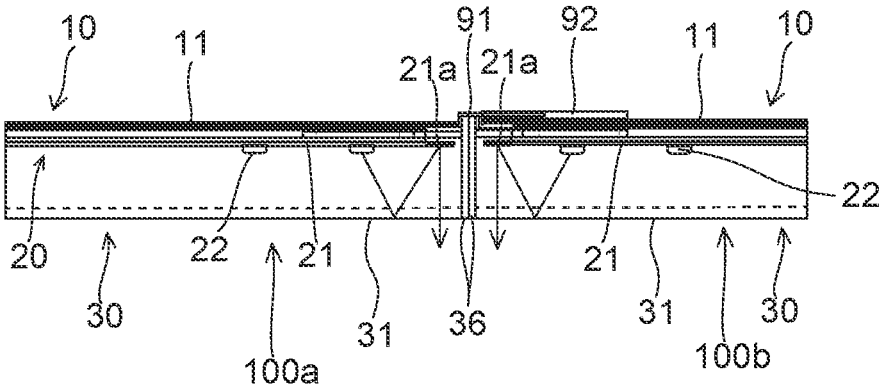
FIG. 17A is a schematic cross-sectional view of adjacent portions of two lighting appliances according to one embodiment of the present invention.

FIG. 17A is a schematic cross-sectional view of adjacent portions of the first lighting appliance 100*a* and the second lighting appliance 100*b*.

A white light reflecting layer, for example, is formed on the light source mounting surface of the substrate 21 on which the light sources 22 are mounted. On the adjacent portion side of the lighting appliance 100, an end portion 21*a* of the substrate 21 on which the light reflecting layer is formed can be located approximate to the side cap 36, so that it is possible to reduce the dark portions of the region outward of the outermost light source 22 on the substrate 21 described above.

Figure 17B:
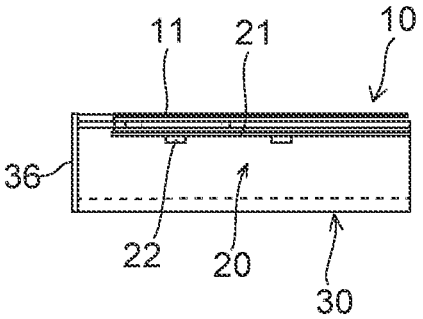
FIG. 17B is a schematic cross-sectional view of an end portion on a non-adjacent side of the lighting appliance according to one embodiment of the present invention.

FIG. 17B is a schematic cross-sectional view of an end portion on the non-adjacent side of the lighting appliance 100.

On the non-adjacent side, which is a side at which the lighting appliance 100 is not closely adjacent to the other lighting appliance 100, of the lighting appliance 100, the substrate 21 can be disposed farther from the side cap 36 than the adjacent side illustrated in FIG. 17A, so that the substrate 21 can be prevented from appearing shaded when viewed from the lateral surface of the cover 30.

Figure 18:
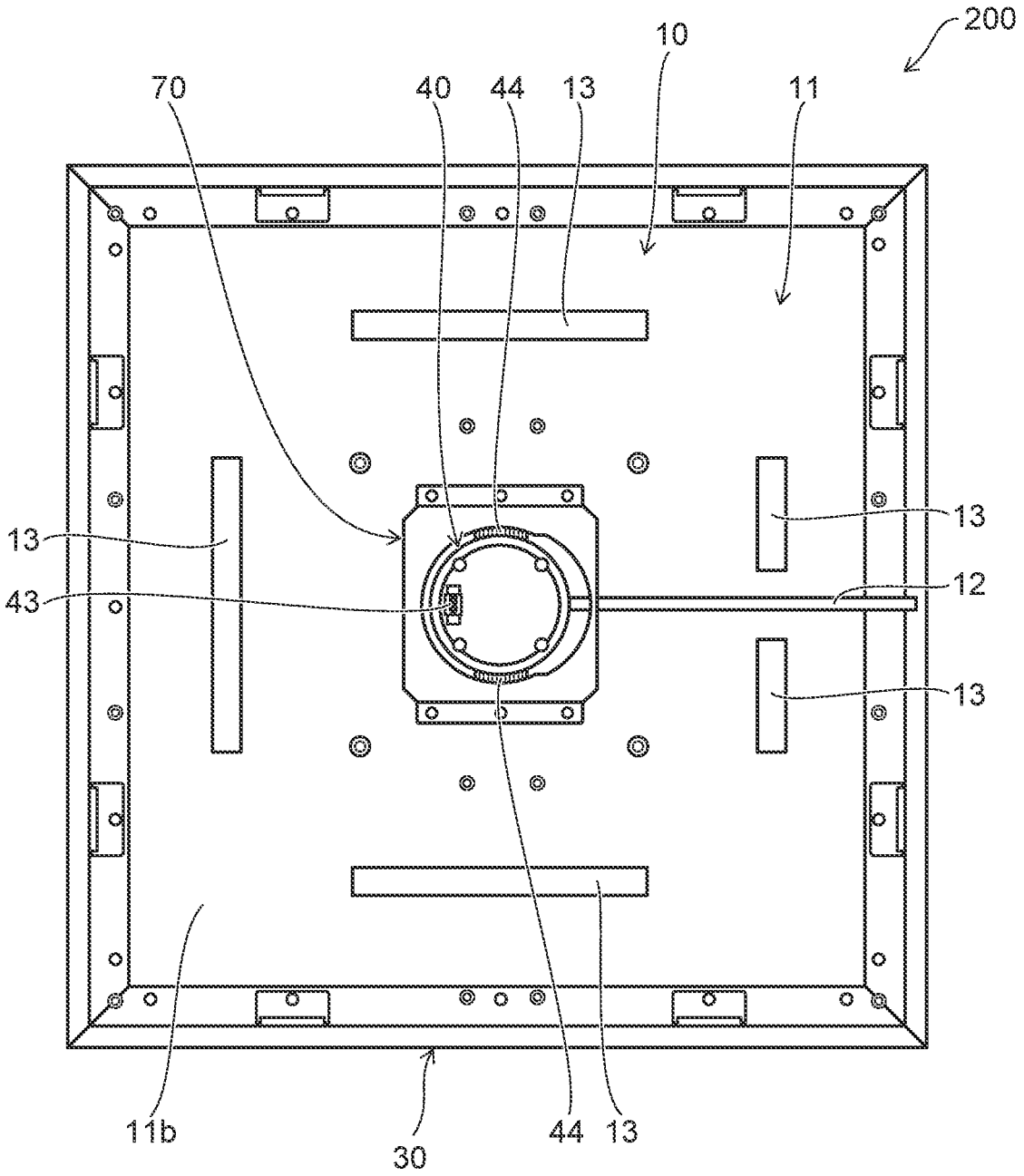
FIG. 18 is a plan view of a rear surface of a lighting appliance according to another embodiment of the present invention.

FIG. 18 is a plan view of a rear surface of a lighting appliance 200 according to another embodiment of the present invention.

The lighting appliance 200 has a square-shaped light emitting surface. The outer shape of the lighting appliance body 10 is also square. The configurations of the lighting appliance body 10, the cover 30, the fitting adapter 40, the adapter securing member 80, the adapter holding member 70, the detachment member 12, and the like are the same as those of the lighting appliance 100 according to the above-described embodiment, and the functions and effects thereof are also the same.

In such a square lighting appliance 200 as well, the first coupling member 91 and the second coupling member 92 described above can be provided on the rear surface 11*b* of the chassis 11. Then, a plurality of the lighting appliances 200 provided with the first coupling member 91 and the second coupling member 92 can be arranged closely adjacent to each other by causing respective lateral surfaces of the cover 30 to abut each other and causing the first coupling member 91 and the second coupling member 92 to overlap each other on the rear surface 11*b* of the chassis 11. For example, the plurality of lighting appliances 200 can be arranged closely adjacent to each other in one direction. Alternatively, four lighting appliances 200 can be arranged closely adjacent to each other in a square shape, for example.

Figure 19:
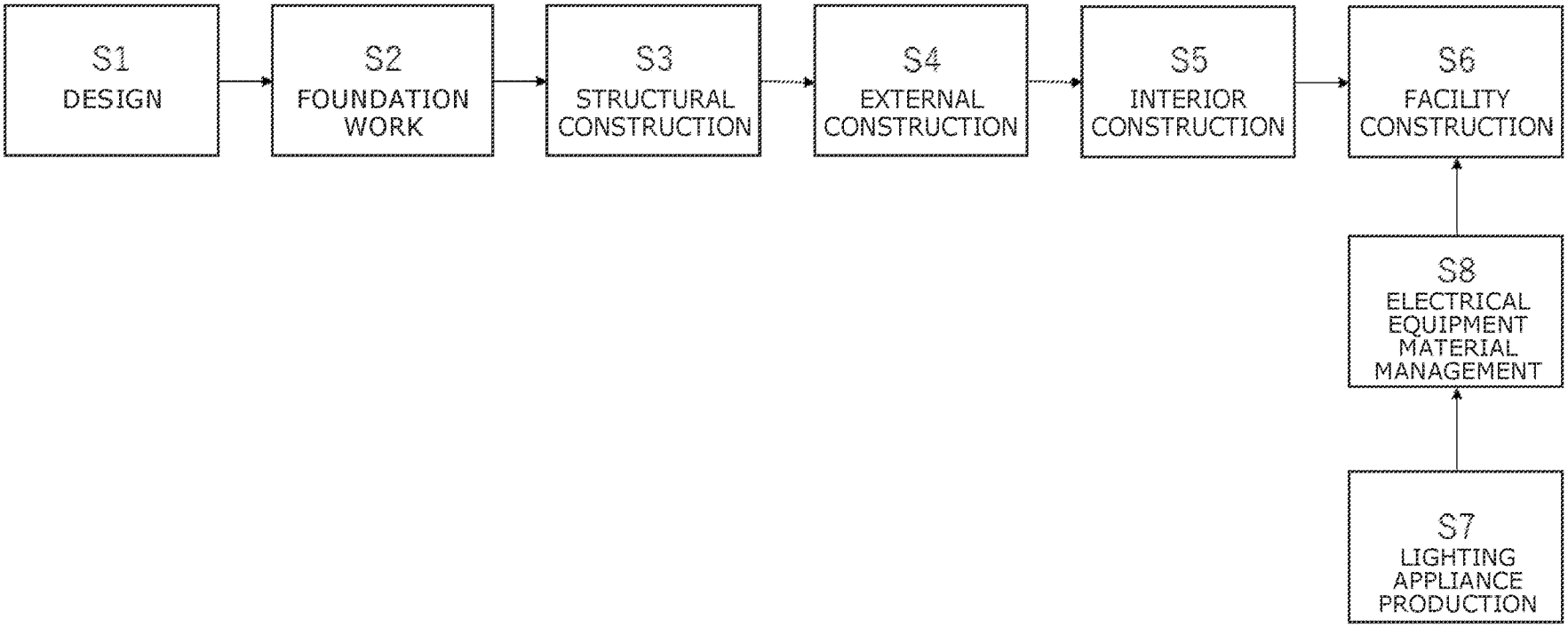
FIG. 19 is a flow diagram for describing the flow of lighting installation in steps until a building is constructed.

Next, as one embodiment, a process in which a lighting fixture 400, such as the lighting appliance 100 or the lighting appliance 200 described above, is installed during construction of a building such as an office building, a factory, or a commercial facility will be described. First, conventional process in construction of such a building will be described. FIG. 19 is a flow diagram for describing the flow of lighting installation in steps until a conventional building is constructed. The process described herein is applied for buildings having a multi-floor structure and having corridors and rooms, such as a general office building. In the construction of large-scale buildings such as office buildings, a general constructor undertakes the order of constructive work and arranges all of the construction works performed by various kinds of agents.

First, a design architect or designer designs the building (step S1). In this step, the layout of the corridors, the rooms, and the like is decided, and the overall design of the building is depicted in design drawings. The building materials to be employed and the electrical equipment materials such as lighting fixtures are also determined to a certain degree, and the arrangement of these materials is also depicted in the drawings.

Subsequently, based on the determined design, building materials and construction machinery are prepared, and the foundation work is performed (step S2). In this step, a stable foundation that can withstand the load of the building is ensured by pile construction or earth construction. In the example herein, work is mainly performed by workers of agents performing civil engineering. Not only workers of civil engineering agents but also workers of other agents work as well.

Subsequently, structural construction of forming the structural body of the building on the stable foundation is performed (step S3). In a case in which the building includes a base part or basement floors, the structural construction begins with basement construction, such as construction of the basement floors, and advances to the ground floor. Concrete casting, positioning of piles, steel frame assembly, and the like are performed to complete the overall framework of the building. Concrete is also poured onto the outer walls, roof, floor of each story, and the like.

During the structural construction, inserts are embedded in order to hang hanging bolts used in the subsequent interior construction. For example, a ceiling insert used for fixing a hanging bolt is fixed as part of a slab when a floor slab (such as a reinforced concrete flooring) of the upper floor is cast. In the example herein, the work is mainly performed by workers of agents performing civil engineering, and workers of agents performing steeplejack work, earthwork, and concrete construction. Subsequently, the external construction of the building is performed (step S4). The outer walls are tiled, and window sashes, window glass, curtain walls, and the like are attached. Painting or the like is also performed.

Subsequently, the interior construction is performed (step S5). During the interior construction, the ceiling, walls, and floors are built up. When performing ceiling construction for installing ceilings, ceiling materials, which are members that configure ceiling surfaces such as ceiling boards or ceiling base materials, are attached to bases of combined lightweight steel frame materials, with the hanging bolts hanging from the ceiling inserts provided in the structural construction of step S3. Hanging materials such as hanging bolts and hangers and diagonal members are used to support the ceiling materials. With such materials, measures for preventing dangers for falling of the ceiling boards are taken.

For example, in Japan, provisions for preventing ceilings from falling are stipulated in the Building Standard Act, Enforcement Order, and the like. Among these standards, one standard states that falling prevention measures such as securing the ceilings by using hanging materials be performed when ceiling materials satisfying predetermined conditions are used. Depending on size, weight, and other factors, some lighting fixtures can be installed on a ceiling without being fixed by hanging materials, and other lighting fixtures are fixed by using hanging materials.

Instead of installing the ceiling inserts used for fixing the hanging bolts during concrete casting, the hanging bolts can be fixed by fixing an anchor to the concrete after casting. However, in consideration of efficiency and safety, it is preferable that the ceiling insert be disposed in advance, and for locations where it is known that hanging materials will be provided, it is preferable that the position of the ceiling insert be determined at the design stage and the ceiling insert be embedded during concrete casting.

During interior construction, before the ceiling is finished, that is, before the ceiling is formed by the ceiling material, work is also performed of suspending ducts and air conditioning ducts, and wirings and the like are passed into the ducts. Therefore, space necessary for installing electrical wiring, ducts, air conditioning devices, and the like is provided on the rear of the ceiling. Furthermore, openings are formed in the ceiling material according to the locations where lighting or air conditioning is installed. The work of installing ducts in the ceiling and securing the ceiling material by using the hanging material is performed by workers of agents that perform interior construction. On the other hand, the work of providing the electrical wiring is carried out by specialized workers that can perform electrical work due to danger of electric shocks and the like.

It is assumed that the workers performing ceiling construction in which the ceiling is installed and the workers performing wiring work in which the electrical wiring is passed through the rear of the ceiling are often different workers. In Japan, electric construction such as wiring work is not permitted to be performed by a person not having electric construction credentials. Thus, when constructing buildings, one needs to consider the safety of workers that are dispatched from a variety of professional agents, each of which performs specialized tasks.

In the present specification, a worker who prepares the ceiling material for construction of a building and performs ceiling construction is referred to as a ceiling installation worker. A worker who prepares electrical wiring for construction of a building and performs wiring work is referred to as a wiring construction worker. The construction described in each of the steps for construction of a building is typically performed by a plurality of workers. Therefore, a ceiling installation worker is not limited to a single worker and refers to one or more workers who perform ceiling construction when constructing buildings. The same applies to the wiring construction worker and other workers.

Subsequently, when interior construction is completed and the floors, walls, and ceilings are finished, installation work is performed (step S6). In the installation work, equipment that is required when actually using the building is installed. For example, facilities for electricity, gas, water supply, water discharge, air conditioning, toilets, disaster prevention, broadcasting, and the like, and facilities for lighting, escalators, elevators, and the like are installed. These works are performed by workers of agents such as electric construction, electrical communication construction, water supply facility construction, fire extinguishing facility construction, and cleaning facility construction.

In the installation work for lighting, electrically connection to lighting fixtures are needed to be performed, so that the work needs to be carried out by a worker having electric construction credentials. While the lighting may be installed in locations other than a ceiling, lighting fixtures installed on the ceiling are usually connected to a wiring provided on the rear of the ceiling and electrically connected to each other by a worker having electric construction credentials. Even in a case in which an air conditioning device is installed in the ceiling during facility construction for air conditioning, the air conditioning device is connected to the wiring provided on the rear of the ceiling by the worker having electric construction credentials.

Typically, in a room of a building such as an office building, a large lighting fixture or air conditioning device disposed in a ceiling is fixed by using a hanging material. Therefore, a worker that performs the installation work of such a large lighting fixture or air conditioning device can also perform work of securing the large lighting fixture or air conditioning device on a hanging material suspended from a ceiling insert and installing the large lighting fixture or air conditioning device in the ceiling.

The manufacturer of the lighting fixtures manufactures lighting fixtures necessary for construction and delivers these fixtures to an electrical material commercial company that manages electrical equipment materials so as to ensure that the installation work of the lighting is completed on time (step S7). The electrical material company manages the stock of materials of not only lighting fixtures but also switches, outlets, wirings, cables, power distribution boards, and antennas, and materials such as switch boards, interphones, and fire detectors, and supplies the required electrical equipment materials required for construction in the required amount (step S8). In the present specification, an employee of an agent that manufactures lighting fixtures or delivers lighting fixtures is referred to as a lighting fixture supplier.

In the step of installation work, the installation work of the lighting is performed separately from the installation work of the air conditioning. Both of these installation works can be performed simultaneously or by the same person, but it is common to share work in consideration of work efficiency. Thus, the building is constructed.

In the present specification, the term "worker for installation work" is intended to refer to one or more workers who perform installation works for lighting or air conditioning, and can include a case in which the installation work for lighting and air conditioning is performed by the same person as described above. On the other hand, the term "worker for installation work of lighting" is intended to refer to one or more workers who perform installation work for lighting, and refer to workers who do not perform installation work for air conditioning. The term "worker for the installation of air conditioning" is intended to refer to one or more workers who perform installation work for air conditioning, and refers to workers who do not perform installation work for lighting.

Figure 20:
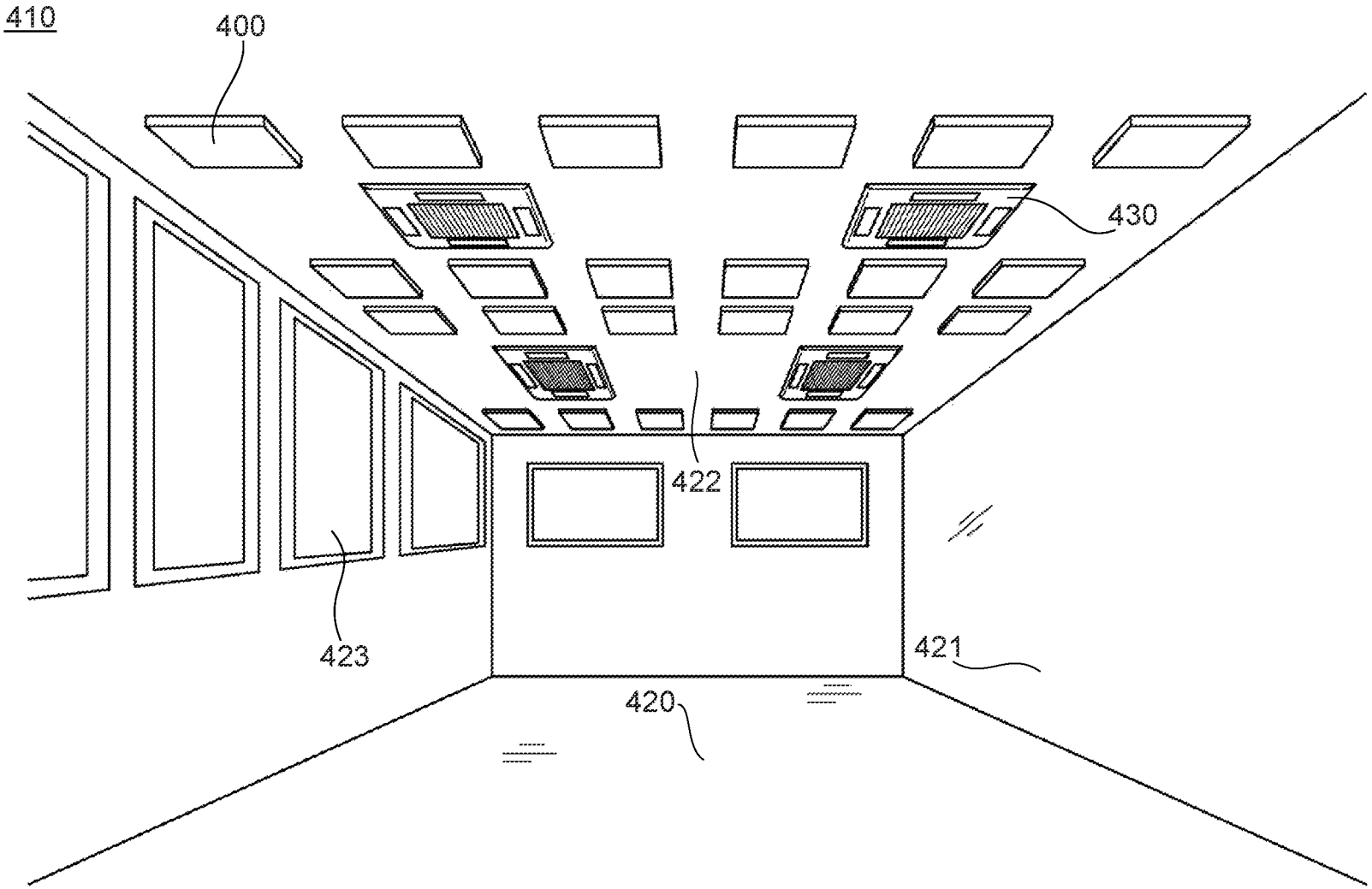
FIG. 20 is a schematic diagram illustrating an example of a structure of a room in a building according to an embodiment.
Figure 21:
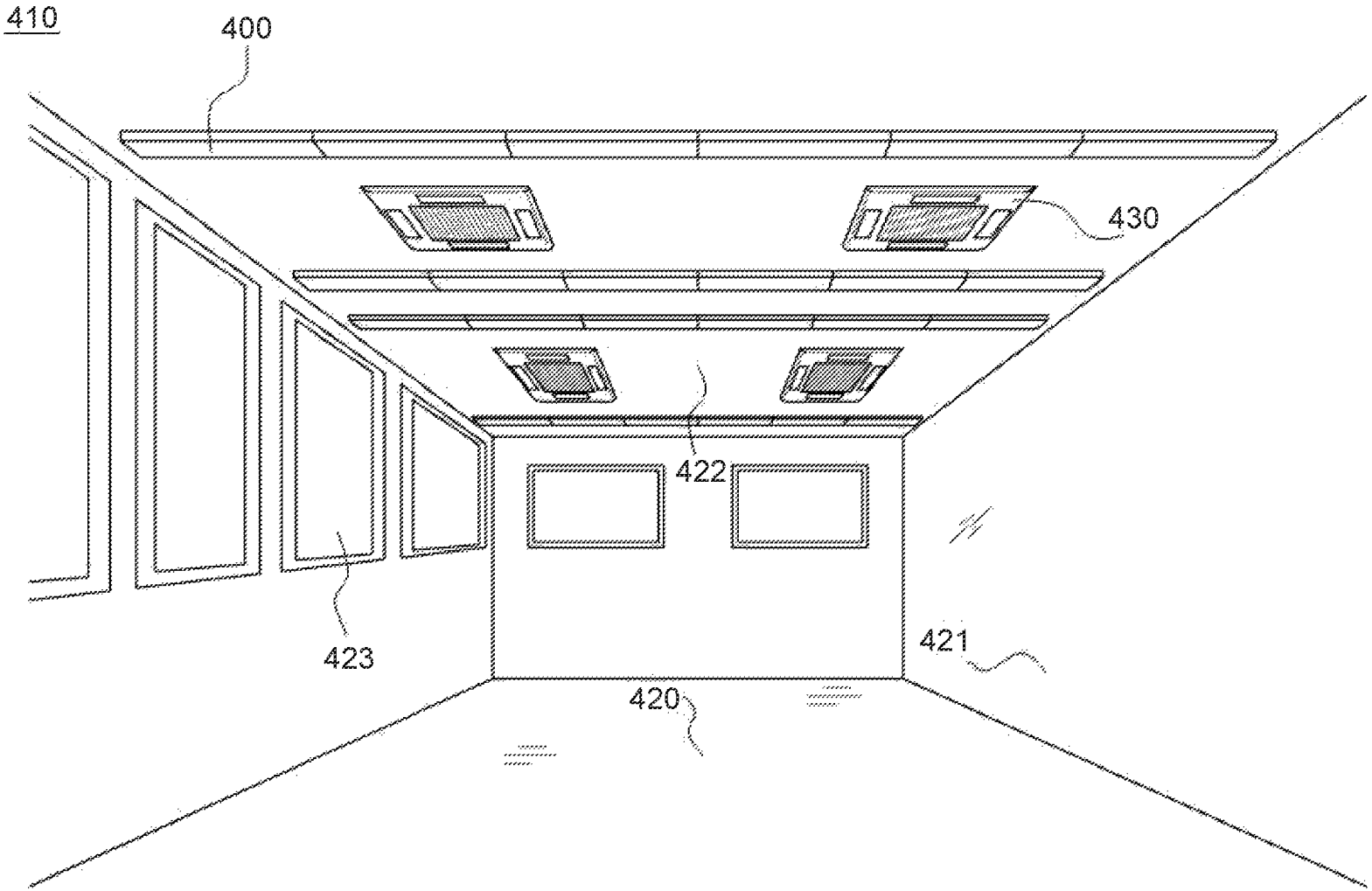
FIG. 21 is a schematic diagram illustrating another example of a structure of a room in a building according to an embodiment.

Next, as an embodiment, a step for constructing a building and a step for installing lighting fixtures 400 in this construction will be described. The lighting appliance 100 or the lighting appliance 200 described above can be used for the lighting fixtures 400 described herein. A building 410 according to the present embodiment has a multi-floor structure and includes corridors and rooms. The building 410 may have a one-floor structure. FIGS. 20 and 21 are schematic diagrams illustrating an example of a structure of a room on a specific floor of the building 410.

In the building 410, a floor 420, walls 421, a ceiling 422, and windows 423 form a room space. The building 410 may have a room that does not have a window 423 and defined by lateral surfaces formed only of the walls 421. A plurality of lighting fixtures 400 and a plurality of air conditioning devices 430 are installed in the ceiling. A single air conditioning device 430 may be installed.

Ceiling installation instruments for a lighting fixture or air conditioning device installed in a ceiling can include those which are necessary or not necessary to be fixed directly by a hanging material. As an example, a small ceiling installation instrument such as a monitoring camera, a downlight, an emergency light, or a smoke detector is installed without being directly fixed by a hanging material such as a hanging bolt or a diagonal member. Such a small ceiling installation instrument applies a small load to the ceiling material, and thus is allowed to be installed without using a hanging material. Hereinafter, such a ceiling installation instrument is referred to as a "ceiling installation instrument that does not need to be fixed by a hanging material".

On the other hand, ceiling surface mounted base lighting, ceiling embedded base lighting, the air conditioning devices 430, and the like are installed in a fixed manner by being directly connected to a hanging material. Such a ceiling installation instrument applies a large load to the ceiling material, and thus poses an increased risk of falling off if, for example, an earthquake occurs and the ceiling installation instrument is not fixed by a hanging material. Thus, the ceiling installation instrument is supported by a hanging material without employing an installation configuration in which all loads are applied to the ceiling material. Hereinafter, such a ceiling installation instrument is referred to as a "ceiling installation instrument that needs to be fixed by a hanging material".

For example, in a case of a building such as an office building, it is conceivable that small ceiling installation instruments such as downlights are provided for lighting a narrow space such as a corridor, and a large lighting fixture such as base lighting is provided across a wide space such as a room. Small lighting fixtures can be provided in parts of the room, but the majority of lighting fixtures installed in the entire room are large lighting fixtures.

The lighting fixture 400 according to the present embodiment has features corresponding to base lighting as features of the lighting fixture, and can be a lighting fixture that does not need to be fixed by a hanging material during lighting installation work. In other words, the lighting fixture 400 is a lightweight large lighting fixture that is large enough to be handled as a base lighting equivalent product while being lightweight so that a hanging material is not required.

In the present specification, the term "lightweight large lighting fixture" refers to a lighting fixture that meets at least one of the following requirements: total luminous flux is equal to or greater than 2500 lm; area of the light emitting surface, which is the surface closest to the floor, is equal to or greater than 45000 $mm^2$, and 100 or more light source elements are disposed. Alternatively, in addition to this, the characteristics of the lightweight large lighting fixture may be further specified by a condition that the weight of the lighting fixture is 0.5 kg or greater and less than 2.5 kg.

The lighting fixture 400, which is a lightweight large lighting fixture, can be, for example, a lighting fixture having a height of 450 mm, a width of 450 mm, and a height of 20 mm from the ceiling installation surface to the light emitting surface, with the light emitting surface having a square shape. The light emitting surface of the lighting fixture may be a square shape with a length of 600 mm and a width of 600 mm. The light emitting surface of the lighting fixture may be a rectangular shape having a length of 150 mm and a width of 600 mm, or can be a rectangular shape having a length of 75 mm and a width of 600 mm.

Thus, designing the length of the lighting fixture in the vertical and horizontal directions to be 600 mm or to be a length obtained by diving 600 mm by a natural number allows the lighting fixture to be more compatible with the ceiling material 300. In building standards in Japan, building materials such as ceiling materials are treated on a shaku basis, and the length of ceiling materials in the vertical and horizontal directions is designed based on approximately 300 mm units. Therefore, matching the vertical and lateral widths of the lighting fixture 400 to the vertical and lateral widths of the ceiling material 300 facilitates installation even in a case in which the lighting fixtures 400 are arranged side by side. The lighting fixture 400 can correspond to the dimensions of the ceiling materials in accordance with building standards at locations where the building is built, and thus the 300 mm unit is not necessarily the standard.

The lighting fixture 400 that does not need to be fixed by a hanging material places the load of the lighting fixture 400 on the ceiling material 300. Therefore, it is desirable to install one lighting fixture 400 in one ceiling material 300. In consideration of balancing the load, it is desirable that the center of gravity of the lighting fixture 400 be centered on the ceiling material 300. When the vertical and horizontal dimensions of the lighting fixture 400 correspond to the vertical and horizontal dimensions of the ceiling material in accordance with the standards of the building materials, a design that satisfies these installation conditions can be easily achieved.

In particular, as illustrated in FIG. 21, in a case in which the lighting fixtures 400 are installed in a coupled manner, if the vertical or horizontal dimensions of the lighting fixtures 400 do not match the vertical or horizontal dimensions of the ceiling material, the installation locations of the lighting fixtures 400 in adjacent ceiling materials 300 differ from each other. The larger the number of couplings, the more the offset occurs in a chain manner, which results in worse balance of load.

Next, steps until the lighting fixture 400 is installed in construction of the building 410 will be described. Works different from the steps until the construction of the building described above with reference to FIG. 19 will be described in detail, and description repeated from the description above will be simplified or omitted.

The lighting fixture 400 need not be fixed by a hanging material 470, and accordingly, in the step S1, the design architect or designer need not determine the placement position of the hanging material for the installation position of the lighting fixture 400. When the installation position of the base lighting that needs to be fixed by a conventional hanging material is changed after the ceiling insert is provided and the placement position of the hanging material 470 is determined, a new hanging bolt needs to be installed. However, such installation is not needed when using the lighting fixture 400. Thus, the design architect or designer can flexibly change the installation position of the lighting fixture 400 even after construction has proceeded to some degree.

Figure 22:
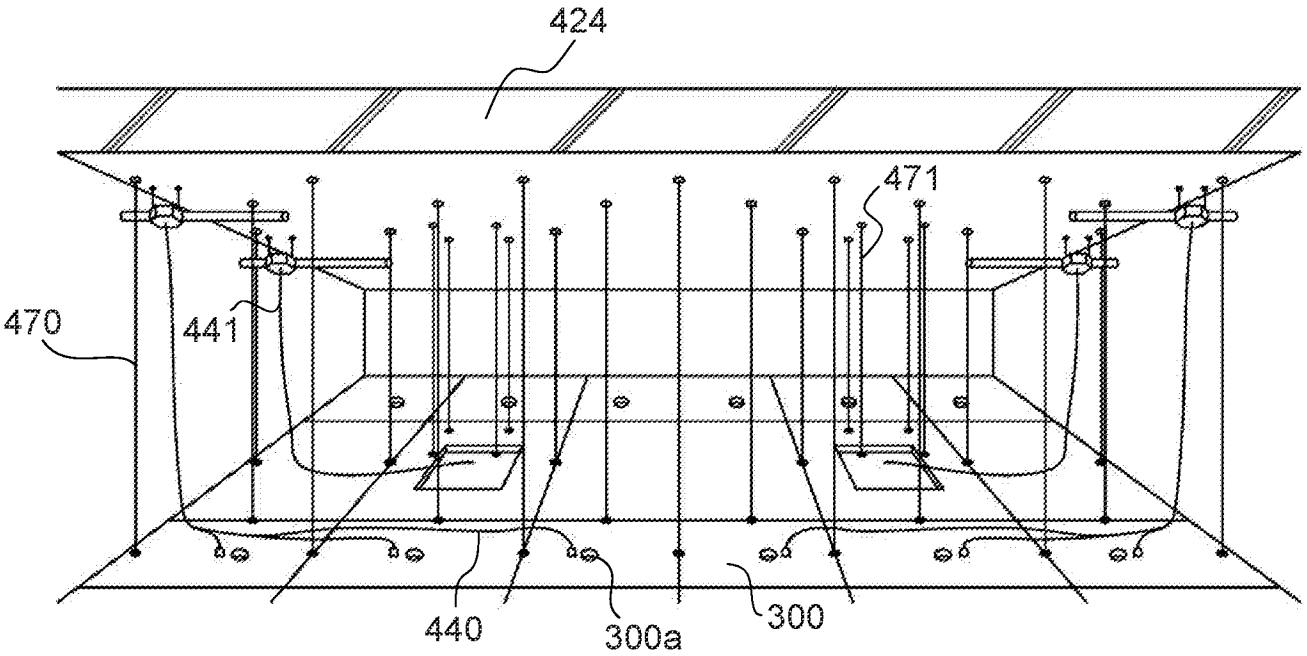
FIG. 22 is a schematic diagram illustrating a structure of a ceiling rear space in construction of a building according to an embodiment.

Steps from step S2 to step S4 are generally similar to those described above. Subsequently, in the interior construction of step S5, ceiling construction is performed in which a ceiling is provided. The wiring disposed on the rear of the ceiling is passed to a position higher than the ceiling before the ceiling is finished or after the ceiling is finished. FIG. 22 illustrates an example of the rear of a ceiling in a state in which ceiling construction has been performed.

As illustrated in FIG. 22, the rear of the ceiling includes a space defined by an upper surface, lateral surfaces, and lower surfaces, the upper surface and the lateral surfaces of the ceiling being formed by a structural body 424 where concrete is cast, and the lower surface of the ceiling being formed by the ceiling 422 where the ceiling material 300 is disposed. Each piece of ceiling material 300 that forms the ceiling 422 is fixed and supported by the hanging material 470 connected to a ceiling insert of the structural body. Illustration of the hanging material 470 is partially omitted in FIG. 22 to simplify the drawing. The space on the rear of the ceiling includes a wiring 440 and a wiring 441 provided through ducts. These wirings are provided based on the design drawing according to the number of installed electrical connection devices such as lighting or air conditioning installed in the ceiling rear. After sufficient wiring is provided for supplying power to the electrical connection devices, the ceiling 422 is provided.

The work of passing wirings in the rear of the ceiling is performed by a wiring construction worker having electric construction credentials. In this work, for the wiring 440 to be connected to the lighting fixture 400, a connector is provided by the wiring construction worker having electric construction credentials. This connector is an example of an electric shock prevention connection instrument used for preventing electric shocks in connection work between an electrical connection instrument and the wiring 440 used for electrically connecting the electrical connection instrument.

With an electric shock prevention connection instrument such as a connector, the work of connecting the wiring 440 to the lighting fixture 400 can be performed even by a person not having electric construction credentials. In the example of FIG. 22, a connector is provided for the wiring 440 to be connected to the lighting fixture 400, while an electric shock prevention connection instrument such as a connector is not provided for the wiring 441 to be connected to the air conditioning device 430. Therefore, in order to comply with the legislation of Japan at the time of filing, the work of connecting the wiring 441 to the air conditioning device 430 needs to be performed by a person having electric construction credentials. Illustration of the wiring 440 is partially omitted in FIG. 22 to simplify the drawing.

In this manner, in the work of providing the wirings disposed on the ceiling rear, work is performed of installing, among a plurality of wirings disposed on the ceiling rear, the wiring 440 provided with an electric shock prevention connection instrument such as a connector as a wiring for electrical connection to the lighting fixture 400 that is not fixed by a hanging material when installed in the ceiling.

The air conditioning device 430 is to be fixed by a hanging material, and thus a hanging material 471 is provided as the hanging material for securing the air conditioning device 430. FIG. 22, illustrates a state in which the air conditioning device 430 is not yet attached, and thus the hanging material 471 does not fix the air conditioning device 430.

An opening is formed in the ceiling material 300 for installing a ceiling installation instrument, such as the air conditioning device 430 and the lighting fixture 400. The square opening illustrated in FIG. 22 is an opening for the air conditioning device 430. The circular opening is the mounting hole 300*a* for the lighting fixture 400. In the example of FIG. 22, among 6*3, total of 18, ceiling materials 300, an opening for installing the air conditioning device 430 is formed in each of two ceiling materials 300, and an opening for installing the lighting fixture 400 is formed in each of 12 ceiling materials 300.

As illustrated in FIG. 22, the mounting hole 300*a* provided for installing the lighting fixture 400 is smaller than the ceiling material 300. The opening is also sufficiently smaller than the light emitting surface of the lighting fixture 400. In contrast, downlights and emergency lighting include an opening equivalent to the size of the lighting fixture. In the lighting fixture 400, the size of the mounting hole 300*a* can be set to ⅓ or less than the area of the light emitting surface. Alternatively, the size of the mounting hole 300*a* can be set to ⅕ or less than this area. Alternatively, the size of the mounting hole 300*a* can be set to 1/10 or less than this area.

The mounting hole 300*a* for installing the lighting fixture 400 has, for example, a circular shape with a diameter in a range of from 10 cm to 15 cm. The shape of the mounting hole 300*a* need not necessarily be circular, and may have a polygonal shape with a maximum diameter of 15 cm or less. The shape of the mounting hole 300*a* can be determined based on the size and shape of the power supply adapter 450 or other factors. In order to attach the lighting fixture 400, it is preferable that the mounting hole 300*a* be sized so that the arm of a worker can pass through the mounting hole 300*a* to take the wiring 440 from the room side by hand.

It is not necessary to provide the ceiling material 300 in which an opening has been formed. It is more common to prepare a ceiling material 300 without an opening and have a worker form an opening by creating a hole in the ceiling material 300 at the site where the interior construction is performed. The work of forming an opening in a ceiling material 300 with no opening can be performed as appropriate. The shape of the opening to be provided can also depends on the ceiling installation instrument to be installed. Thus, the opening may be formed when the ceiling material 300 is fixed by the hanging material 470 and attached to the ceiling, or may be provided after the ceiling is formed.

Figure 23:
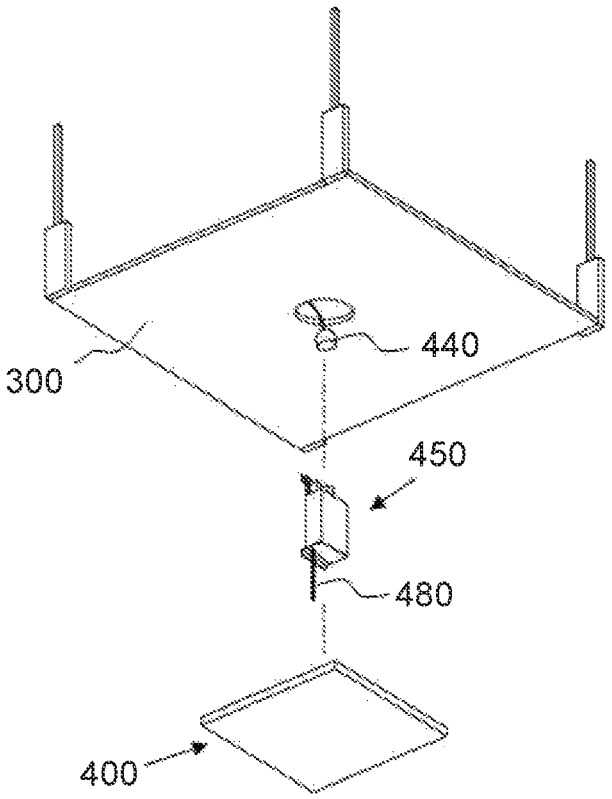
FIG. 23 is a schematic diagram for describing a method for installing a lighting fixture according to an embodiment.

After the ceiling 422 is provided in this manner, the installation work of lighting is performed in the facility construction of step S6. FIG. 23 is a schematic diagram illustrating the connection relationship between the connector-attached wiring 440, the ceiling material 300, a power supply adapter 450, and the lighting fixture 400. The installation work of lighting can be performed even by a person who does not have electric construction credentials.

When the ceiling 422 is provided in the building 410, the room space, which is the space that forms the room illustrated in FIG. 20, and the ceiling rear space, which is the space that forms the rear of the ceiling illustrated in FIG. 22, can be regarded as distinct spaces. Here, the presence or absence of the opening in the ceiling material 300 is not considered. Specifically, in a case in which a ceiling material 300 that does not include an opening is used to form the ceiling 422 in the building 410, the space located above the ceiling 422 and including the ceiling 422 as a portion forming the space is distinguished as the ceiling rear space, and the space located below the ceiling 422 and including the ceiling 422 as a portion forming the space is distinguished as the room space.

First, the lighting fixture 400 and the power supply adapter 450 are provided in the room space by a worker present in the room space. The lighting fixture 400 is connected to the power supply adapter 450 by a worker present in the room space fitting the mounting adapter of the lighting fixture 400 into the power supply adapter 450. The lighting fixture 400 is connected with a DC harness 480 of the power supply adapter 450 to be powered by DC power supply from the power supply adapter 450. For example, a DC voltage of 100 V is supplied. The connection to the DC harness 480 can also be performed by a worker that does not have electric construction credentials. The fitting adapter 40 corresponds to one form of the mounting adapter. The power supply unit 50 corresponds to one form of the power supply adapter 450. The electrical cable 51 corresponds to one form of the DC harness 480.

Because AC power supply is supplied via the wiring 440, the power supply adapter 450 has an AC/DC conversion function. The power supply adapter 450 includes an AC terminal stand 460 as a connection portion used for electrical connection to the connector-attached wiring 440 via a connector. The worker present in the room space passes an arm through the opening and pulls the connector-attached wiring 440 provided in the ceiling rear space from the opening and pulls the connector-attached wiring 440 into the room space. Then, the connector of the connector-attached wiring 440 and the AC terminal stand 460 are connected in the room space. The terminal stands 52 and 53 correspond to one form of the AC terminal stand 460.

With regard to a case in which the lighting fixture 400 has a lighting control function that adjusts the intensity and/or tone of light emission, the power supply adapter 450 includes a lighting control terminal stand as a connection portion for connecting to a lighting control driver device that controls the lighting control. In a case in which a lighting fixture 400 is used that does not have a lighting control function, lighting control terminal stands are not needed.

In this manner, work is performed to connect the connector-attached wiring 440 disposed in the ceiling rear space above the formed ceiling 422 and the power supply adapter 450 by using a connector of the connector-attached wiring via the opening provided in the ceiling material 300.

Figure 24:
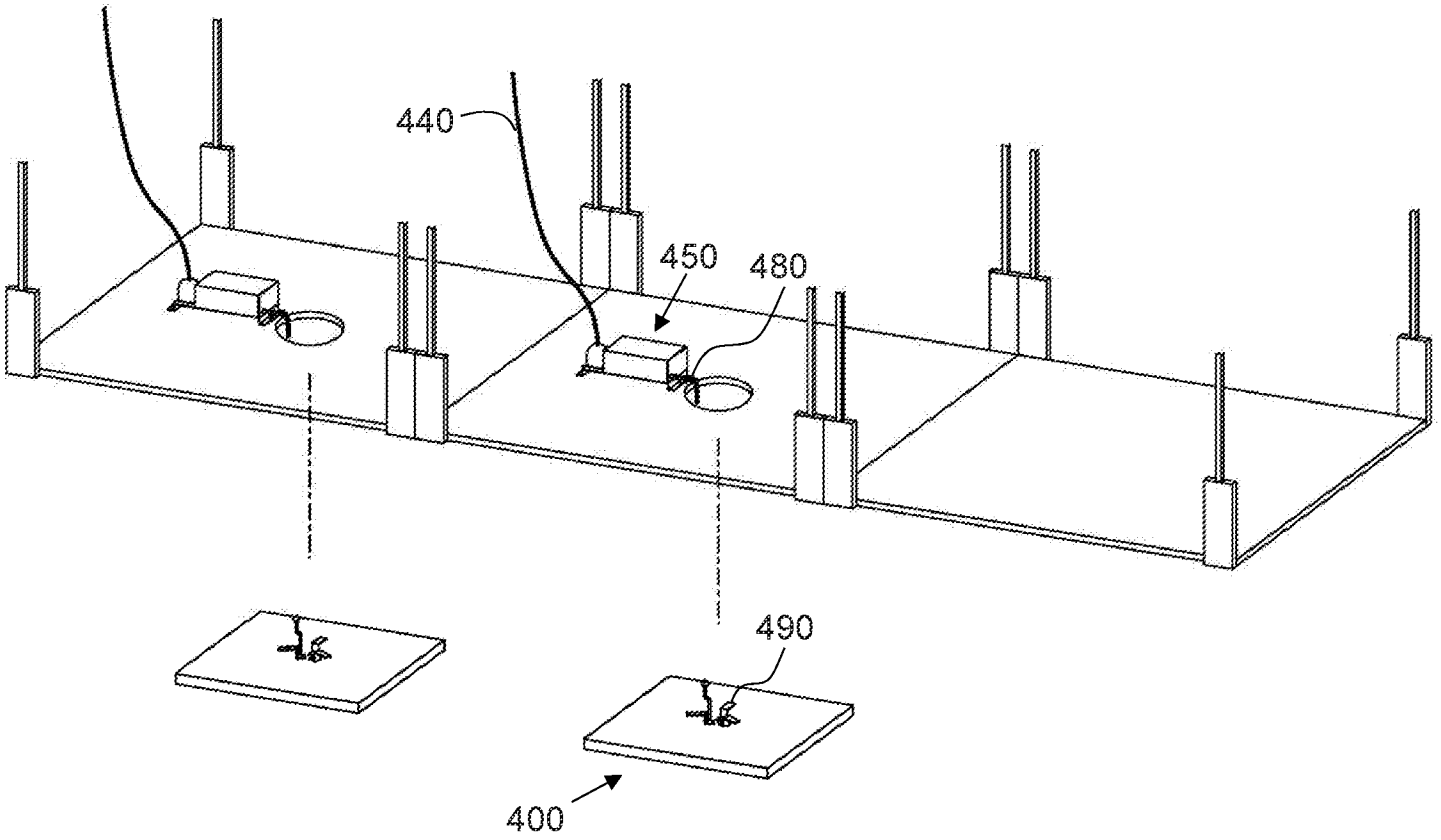
FIG. 24 is a schematic diagram for describing a method for installing a lighting fixture according to an embodiment.

As illustrated in FIG. 24, a worker present in the room space installs the power supply adapter 450 to the ceiling material 300. The worker in the room space places the power supply adapter 450 connected to the connector-attached wiring 440 on the rear of the ceiling via the opening through which the connector-attached wiring 440 to be connected is passed. The connector-attached wiring 440 returns to the rear of the ceiling, and the DC harness 480 of the power supply adapter 450 protrudes into the room space from the opening. The lighting fixture 400 is connected to the DC harness 480 and is supplied with power. In this manner, work is performed to electrically connect the lighting fixture 400 provided in the room space below the formed ceiling 422 and the power supply adapter 450.

The lighting fixture 400 includes a fastener 490 and is attached to the ceiling 422 through the fastener 490 being passed through the opening and being hooked on the rear of the ceiling material 300. Each fastener 63 of the lighting fixture 400 has springiness (elasticity) and penetrates through the opening of the ceiling material 300 from the ceiling surface side (the room space side). After penetrating through the opening, the fasteners 63 are hooked on the ceiling rear surface of the ceiling material 300, and thus load is applied to the ceiling material 300. When the lighting fixture 400 is attached to the ceiling 422, the load of one lighting fixture 400 and one power supply adapter 450 is applied to one ceiling material 300. The claw portions 44 correspond to one form of the fastener 490. The fastener 63 is not limited to a structure having springiness and can be any structure that applies load to the ceiling material 300.

Figure 25:
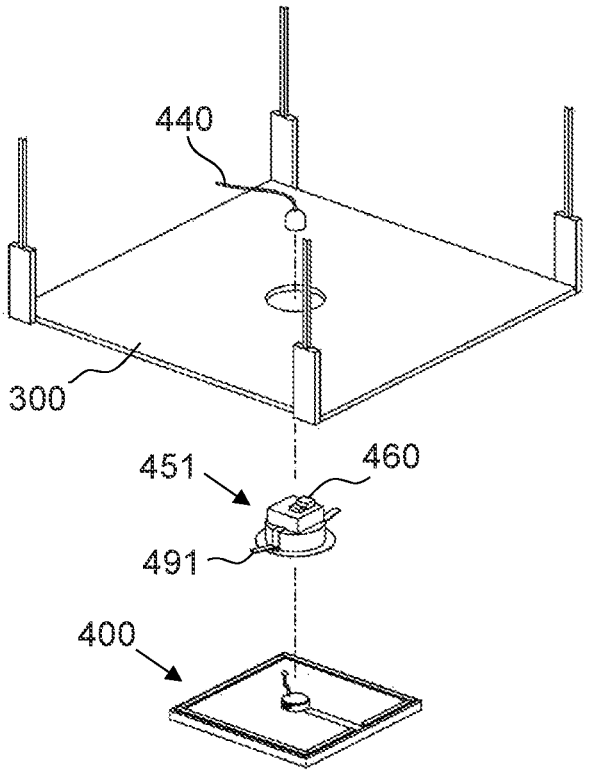
FIG. 25 is a schematic diagram for describing another example of a method for installing a lighting fixture according to an embodiment.
Figure 26:
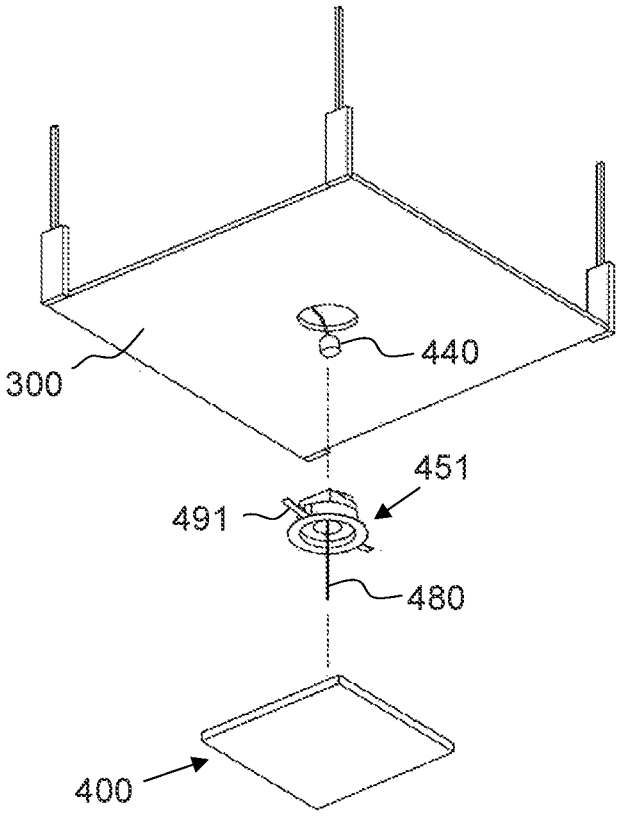
FIG. 26 is a schematic diagram for describing another example of a method for installing a lighting fixture according to an embodiment.

As illustrated in FIGS. 25 and 26, instead of the fastener 490 of the lighting fixture 400 being attached to the opening of the ceiling material 300, a fastener 491 of a power supply adapter 451 may be attached to the opening of the ceiling material 300.

Either the work of connecting the connector-attached wiring 440 and the power supply adapter 450, or the work of connecting the power supply adapter 450 and the lighting fixture 400 may be performed prior to the other. The work of attaching the power supply adapter 450 to the ceiling material 300 may be performed before or after the lighting fixture 400 is connected to the power supply adapter 450.

In this manner, the work of installing the lighting fixture 400 on the ceiling material 300 is performed by passing the fastener 490 of the lighting fixture 400 that is electrically connected to the connector-attached wiring 440 through the opening of the ceiling material 300. Alternatively, the work of installing the lighting fixture 400 on the ceiling material 300 is performed by passing the fastener 491 of the power supply adapter 451 that is electrically connected to the connector-attached wiring 440 through the opening of the ceiling material 300.

Further, work is performed in which the connector-attached wiring 440 and the power supply adapter 450 are connected by the connector of the connector-attached wiring 440, and the power supply adapter 451 electrically connected to the connector-attached wiring 440 is placed in the ceiling rear space. In addition, work is performed in which the lighting fixture 400 is installed on the ceiling material 300.

As described in the embodiment according to the lighting appliance 100, the lighting fixture 400 may be attached to the ceiling material 300 via the mounting bracket 60 having the mounting springs 63 as a fastener. In this case, after performing work in which the power supply adapter 450 that is electrically connected to the connector-attached wiring 440 is placed in the ceiling rear space, a mounting bracket 160 is installed on the ceiling material 300 by a fastener.

The DC harness 480 of the power supply adapter 450 disposed in the ceiling rear space is drawn into the room space through the opening 64 of the mounting bracket 60, and is connected to the lighting fixture 400 in the room space such that the power supply adapter 450 and the lighting fixture 400 are electrically connected. By electrically connecting with the power supply adapter 450, the lighting fixture 400 electrically connects with the connector-attached wiring 440.

The lighting fixture 400 is installed on the mounting bracket 60 in a state in which the power supply adapter 450 and the lighting fixture 400 are electrically connected. The claw portions 44 of the fitting adapter 40 correspond to a fastener used for installing the lighting fixture 400 on the mounting bracket 60. In other words, a fastener of the mounting bracket 60 is used for installation to the ceiling material 300, and a fastener of the lighting fixture 400 is used for installation to the mounting bracket 60.

In this manner, the fastener of the lighting fixture 400 is passed through the opening 64 of the mounting bracket 60, and installation work of installing the lighting fixture 400 on the ceiling material 300 via the mounting bracket 60 is performed. The mounting bracket 60 can be referred to as one form of a mounting aid member that assists installation of the lighting fixture 400 on the ceiling material 300. The mounting aid member may have a shape and structure similar to that of, for example, the mounting bracket 60 and can be formed from a material other than metal.

In a case in which the lighting fixtures 400 are coupled and disposed as illustrated in FIG. 21, adjacent lighting fixtures 400 to be coupled (here, the respective adjacent lighting fixtures 400 are referred to as a first lighting fixture and a second lighting fixture) can be coupled by using the first coupling member 91 of one lighting fixture 400 and the second coupling member 92 of the other lighting fixture 400, as described in the embodiment related to the lighting appliance 100.

First, the first lighting fixture that is electrically connected to the connector-attached wiring is passed through the opening of the ceiling material 300, to install the first lighting fixture on the ceiling material 300. Subsequently, the second lighting fixture electrically connected to the connector-attached wiring is coupled to the first lighting fixture and passed through the opening of the ceiling material 300, to install the second lighting fixture coupled to the first lighting fixture on the ceiling material 300.

As described in the embodiment related to the lighting appliance 100 and the lighting appliance 200, the lighting fixture 400 can be moved in a state in which the lighting fixture 400 is installed on the ceiling material 300, so the position of the lighting fixture 400 with respect to the ceiling material 300 can be adjusted.

In a case in which lighting fixtures 400 are disposed in a coupled manner as illustrated in FIG. 21, in a state in which each of the plurality of lighting fixtures 400 coupled to each ceiling material 300 is installed, the lighting fixtures 400 may be slightly displaced from intended installation positions due to misalignment of the opening of the ceiling materials 300 or the like. It is preferable that such coupled lighting be aligned in an accurate straight line from the perspective of aesthetics.

As such, after the work of coupling and installing the first lighting fixture and the second lighting fixture on the respective ceiling materials 300 is performed, the first lighting fixture or the second lighting fixture is moved to perform the work of adjusting the coupling between the first lighting fixture and the second lighting fixture.

While the first lighting fixture and the second lighting fixture are installed in a coupled manner at the stage of installation on the ceiling 422, the coupling at this stage may be misaligned from the intended state. Therefore, the work of completing the room space in which the plurality of lighting fixtures 400 are coupled and installed on the ceiling 422 in the building 410 includes coupling works divided into two stages including a first coupling work in which the first lighting fixture and the second lighting fixture are coupled and installed to the respective ceiling materials 300, and a second coupling work in which the first lighting fixture or the second lighting fixture installed on the ceiling materials 300 is moved to adjust the coupling between the first lighting fixture and the second lighting fixture after the first coupling work.

The second lighting fixture may be coupled to the first lighting fixture after the position of the first lighting fixture is adjusted. In other words, an operation may be performed to install the second lighting fixture on the next ceiling material 300 to the first lighting fixture and couple the second lighting fixture to the first lighting fixture, after the operation of placing the first lighting fixture on the ceiling material 300 and the operation of adjusting the position of the first lighting fixture are performed in a state in which the first lighting fixture is not coupled to the second lighting fixture. In this case, the second lighting fixture may be coupled to the first lighting fixture while the position is adjusted, or the operation of adjusting the position may be performed after the coupling operation.

For example, in a case in which at least one of the plurality of lighting fixtures 400 installed in a coupled manner on the ceiling 422 is a lighting fixture disposed by the wall 421 and installed in contact with the wall 421, the operation may be performed assuming that the lighting fixture 400 to be installed by the wall is the first lighting fixture and the lighting fixture 400 to be coupled to the lighting fixture 400 by the wall is the second lighting fixture.

According to the example of FIG. 21, the lighting fixture 400 to be installed by the wall is a lighting fixture 400 located at the end in the coupling direction. One lateral surface of the opposing lateral surfaces is a coupling surface that is coupled to another lighting fixture 400, and the other lateral surface is a wall side installation surface installed by the wall without being coupled to the other lighting fixture 400. In a case in which there are three or more lighting fixtures 400 to be coupled, a lighting fixture 400 installed next to a lighting fixture 400 installed by the wall has both opposing lateral surfaces being coupling surfaces coupled to other lighting fixtures 400.

The worker of the installation operation forms an opening in the ceiling material 300 that is installed by the wall. In a case in which the first lighting fixture is installed in a state in which the position can be adjusted in the wall 421 direction, the opening is provided at a position where the wall side installation surface of the first lighting fixture is not in contact with the wall 421 and is provided in the vicinity of the wall 421. The vicinity of the wall 421 is a range in which the first lighting fixture can be brought into contact with the wall 421 by adjusting the position. For example, assuming that the range of movement in which the position can be adjusted is 10 mm, the position of the opening may be designed such that the wall side installation surface is separated from the wall 421 by approximately 5 mm in consideration of errors and tolerances.

Subsequently, the worker of the installation operation installs the first lighting fixture to be installed by the wall to the ceiling material 300 separated from the wall through the opening of the ceiling material 300. At this time, the first lighting fixture is installed in a state in which the position can be adjusted in the direction of the wall 421.

Subsequently, in a state in which the first lighting fixture is installed on the ceiling material 300, the first lighting fixture is moved to a position close to the wall 421, and a predetermined portion of the wall side installation surface of the first lighting fixture is brought into contact with the wall 421. The second lighting fixture is then coupled to the first lighting fixture. The second lighting fixture is also moved to adjust the coupling of the first lighting fixture and the second lighting fixture. With the first lighting fixture adjusted in position so as to be in contact with the wall 421, adjustment in the position with respect to the second lighting fixture is preferably performed by moving the second lighting fixture without moving the first lighting fixture.

The upper limit for one direction for the range of movement in which the position of the lighting fixture 400 installed on the ceiling material 300 can be adjusted may be in such a range from 10 mm to 15 mm. Alternatively, the range of movement may be such a range as to allow movement of 10 mm or greater. This is because it is sufficient that the influences of the misalignment of the mounting holes 300*a*, the member tolerances of the lighting fixture 400, and the like are covered by the range of movement. The adjustment can be performed in a range other than such ranges.

The range of movement is a predetermined range obtained by the mechanism of the lighting fixture 400 in which the lighting fixture 400 can be moved. In other words, the range of movement is not attributed to the relationship with other members such that the movement is allowed by the differences in the fitting portions of the lighting fixture 400 such as the size of the holes of the mounting holes 300*a* and the size of the opening of the mounting bracket 60, but is the allowable range of movement predetermined as the mechanism of the lighting fixture 400.

Adjustments such that the range of movement in one direction exceeds the width of the lighting fixture 400 in that direction, or adjustments exceeding the width of one ceiling material 300 are not included in the meaning of the "adjustments of the positions for covering the influences of tolerances or misalignment" described above. Meanwhile, the lighting fixture 400 may be configured to allow all of these adjustments, that is, adjustments of such different meanings.

In the operation of installing the first lighting fixture and the second lighting fixture on the ceiling materials 300, the first lighting fixture and the second lighting fixture are disposed such that a lighting adjustment member is provided between the coupling surface of the first lighting fixture and the coupling surface of the second lighting fixture. The lighting adjustment member is a member for adjusting the lighting of the coupling portions in coupling a plurality of lighting fixtures 400.

In the description of the embodiment of the lighting appliance 100, the lighting balance between the coupling portions and the other portions are adjusted by setting the lateral surfaces on which the transmittance control member 85 is provided as coupling surfaces. The transmittance control member 85 is an example of the lighting adjustment member. In the embodiment of the lighting appliance 100, each of the first lighting fixture and the second lighting fixture has the transmittance control member 85, but only one of the lighting fixtures 400 may have the transmittance control member 85.

In the embodiment of the lighting appliance 100, the lighting appliance 100 includes the transmittance control member 85 on the lateral surface opposite the coupling surface as well, but do not necessarily have a lighting adjustment member on the lateral surface that is not coupled in a case in which the lighting appliance 100 is not coupled to another lighting fixture 400 on the lateral surface opposite the coupling surface. In any coupling lighting fixture 400, a lighting adjustment member is provided on at least one lateral surface.

In the embodiment of the lighting appliance 100, a lighting appliance 100 having the transmittance control member 85 is provided, but the lighting adjustment member may be separately prepared and provided on a lateral surface as necessary. For example, if the adjustment member is formed of a material that can be attached, the lighting adjustment member can be provided on the coupling surface of the lighting fixture at any timing before the coupling of the lighting fixture.

For example, in a construction site, lighting fixtures 400 in a state in which no lighting adjustment member is provided are prepared, and a lighting adjustment member is provided on the coupling surface of the first lighting fixture 400 or the second lighting fixture at the site where the room space is built. When the lighting adjustment member is constituted by a detachable material having adhesive properties, it is possible to detach the lighting adjustment member even if the lighting adjustment member is provided by mistake on a lateral surface that should not be provided with the lighting adjustment member, and it is also possible to reuse the lighting adjustment member to another lighting fixture 400, which is convenient.

The power supply adapter 451 is disposed near the opening through which the power supply adapter 451 itself has passed and disposed on the rear of the ceiling material 300 having the opening. Accordingly, in a case in which one lighting fixture 400 is attached to one ceiling material 300, one power supply adapter 451 that connects to the lighting fixture 400 is disposed on one ceiling material 300. Therefore, similar to the first embodiment, one power supply adapter 451 and one lighting fixture 210 are the load applied to one ceiling material 300.

The power supply adapter 451 may be disposed on the ceiling material 300 to which a lighting fixture 400 is not attached. For example, the power supply adapter 451 may be moved such that the power supply adapter 451 is disposed on a ceiling material 300 that does not include an opening. Accordingly, the load applied to one ceiling material 300 can be reduced. For example, a total of two power supply adapters 451 each disposed on each of two ceiling materials 300 in FIG. 24 may be disposed on one ceiling material that does not include an opening. However, it is also conceivable that the work of disposing a power supply adapter 451 is difficult or troublesome if the distance to the ceiling material 300 is not at arm's length.

As described above, the installation work of the lighting fixture 400 does not include a fixture with the hanging material 470, so that it is sufficient that an opening is provided only to pull out the connector-attached wiring 440 on the rear of the ceiling into the room space. In other words, in order to perform the work of installing the lighting fixture 400 on the ceiling 422, it is sufficient that an opening of a size that allows an arm to pass through is present. On the other hand, if the lighting fixture requires work to be fixed with the hanging material 470, it becomes difficult to perform the work to attach the lighting fixture from the room space side by using only an opening of a size that allows an arm to pass through.

By providing the connector-attached wiring 440 in advance on the ceiling before the installation work of the lighting fixture 400, even a person with no electric construction credentials can perform work to electrically connect the lighting fixture 400 and the wirings on the rear of the ceiling. Therefore, a worker that opens a hole in the ceiling material 300 for installation as a part of the ceiling can also perform the installation work of the lighting fixture 400.

That is, in construction of the building 410, the lighting fixture supplier supplies the lighting fixture 400 to the ceiling installation worker instead of supplying the lighting fixture 400 to the electrical material company, and the ceiling installation worker can perform ceiling construction with the lighting fixture 400.

Embodiments of the present disclosure have been described above with reference to specific examples. However, the present disclosure is not limited to these specific examples. All aspects that can be carried out by a person skilled in the art modifying the design as appropriate based on the above-described embodiments of the present disclosure are also included in the scope of the present disclosure, as long as they encompass the spirit of the present disclosure. In addition, in the spirit of the present disclosure, a person skilled in the art can conceive of various modified examples and modifications, and it is understood that these modified examples and modifications will also fall within the scope of the present disclosure.

REFERENCE SIGNS LIST

10 Lighting appliance body
11 Chassis
12 Detachment member
20 Light source module
22 Light source
30 Cover
36 Side cap
40 Fitting adapter
44 Claw portion
60 Mounting bracket
70 Adapter holding member
80 Adapter securing member
85 Transmittance control member
91 First coupling member
92 Second coupling member
100 Lighting appliance
100*a* First lighting appliance
100*b* Second lighting appliance
400 Lighting fixture

What is claimed is:

1. A lighting device comprising:
a first lighting unit; and
a second lighting unit,
each of the first and second lighting units including:
a chassis having a front surface and a rear surface opposite to the front surface;
a plurality of light sources disposed on the front surface of the chassis;
an adapter disposed on the rear surface of the chassis and insertable into a mounting hole on a mounting surface of a building material for attachment of the lighting unit to the mounting surface; and
a light-transmissive cover covering the plurality of light sources, wherein
the first lighting unit includes a first coupler disposed on the rear surface at a first end of the first lighting unit,
the second lighting unit includes a second coupler disposed on the rear surface at a second end of the second lighting unit, and
the first coupler is couplable to the second coupler with a first end portion of the light-transmissive cover of the first lighting unit at the first end in contact with a second end portion of the second lighting unit at the second end.

2. The lighting device according to claim 1, wherein in at least one of the first and second lighting units, the adapter is movable relative to the chassis in a first direction along the rear surface of the chassis.

3. The lighting device according to claim 2, wherein
the first coupler is insertable into the second coupler in a second direction that is along the rear surfaces of the chasses of the first and second lighting units and different from the first direction, and
the first lighting unit is movable relative to the second lighting unit in the first direction in a state in which the first coupler is coupled to the second coupler.

4. The lighting device according to claim 1, wherein the first lighting unit further comprises a low transmittance member on the first end surface, a transmittance of the low transmittance member being lower than a transmittance of the first end portion of the light-transmissive cover of the first lighting unit.

5. The lighting device according to claim 4, wherein at least a part of a periphery of the first end portion is not covered with the low transmittance member.

6. The lighting device according to claim 4, wherein the low transmittance member has a reflective property.

7. The lighting device according to claim 6, wherein the low transmittance member is a white resin member.

8. The lighting device according to claim 1, wherein the light-transmissive cover of the first lighting unit includes a main portion facing the front surface of the chassis, and a transmittance of the first end portion is less than a transmittance of the main portion.

9. The lighting device according to claim 1 wherein each of the first and second lighting units includes a detachment member coupled to the adapter, the detachment member configured to cause the adapter to transition between an attachment state and a detachable state, and the adapter is movable relative to the chassis in a first direction along the rear surface of the chassis between a first position at which the detachment member is fully behind the rear surface of the chassis and a second position at which the detachment member is at least partially exposed out of the chassis.

10. The lighting device according to claim 9, wherein the adapter includes a claw that is movable between a third position at which the adapter is in the attachment state and a fourth position at which the adapter is in the detachable state, and the detachment member is movable in the first direction to cause the claw to be in the third position and in the fourth position.

11. The lighting device according to claim 10, wherein the claw is urged toward the third position, and movement of the detachment member array from the adapter in the first direction causes the claw to move to the fourth position against urging of the claw.

12. The lighting device according to claim 11, wherein the claw has a tapered surface, such that the claw contacts the mounting hole and moves toward the fourth position when the adapter is inserted into the mounting hole.

13. The lighting device according to claim 1, wherein the rear surface of the chassis is a rectangular surface, and the first direction is a lateral direction of the rectangular surface.

14. The lighting device according to claim 1, further comprising a reflective member, wherein the light-transmissive cover includes an end portion at an end in a second direction that is along the rear surface and different from the first direction; and the reflective member is disposed on the end portion of the light-transmissive cover.

15. A light installation method of the lighting device according to claim 1 comprising:

installing the first lighting unit to the mounting surface of the building material by inserting the adapter into the mounting hole on the mounting surface and fixing the adapter to a first attachment member in the first mounting hole;

installing the second lighting unit to the mounting surface by inserting the adapter into the mounting hole on the mounting surface and fixing the adapter to a second attachment member in the mounting hole while positioning the second coupler adjacent to the first coupler; and coupling the second coupler to the first coupler and adjusting a relative position of the second lighting unit with respect to the first lighting unit, by moving at least one of the first and second lighting units along the mounting surface.

16. The light installation method according to claim 15, wherein said coupling and adjusting are carried out such that a side surface of one of the first and second lighting units contacts and is aligned with a surface of the other one of the first and second lighting units.

17. The light installation method according to claim 16, further comprising providing a low transmittance member on the side surface of the one of the first and second lighting units.

* * * * *